US011141986B2

(12) United States Patent
Katsuki

(10) Patent No.: US 11,141,986 B2
(45) Date of Patent: Oct. 12, 2021

(54) LIQUID HOUSING BODY AND METHOD FOR MANUFACTURING THE SAME

(71) Applicant: SEIKO EPSON CORPORATION, Tokyo (JP)

(72) Inventor: Kiyoteru Katsuki, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/829,533

(22) Filed: Mar. 25, 2020

(65) Prior Publication Data

US 2020/0307234 A1 Oct. 1, 2020

(30) Foreign Application Priority Data

Mar. 26, 2019 (JP) ..... JP2019-058246

(51) Int. Cl.
*B41J 2/175* (2006.01)

(52) U.S. Cl.
CPC ..... *B41J 2/17553* (2013.01); *B41J 2/17513* (2013.01); *B41J 2/17526* (2013.01)

(58) Field of Classification Search
CPC ..... B41J 2/17553; B41J 2/17526; B41J 2/17513; B41J 2/17523; B41J 2/1752; B41J 2/1753; B41J 2002/17516; B41J 29/02; B41J 2/17503; B41J 2/17559; B41J 2/17563
USPC ..... 347/85
See application file for complete search history.

(56) References Cited

U.S. PATENT DOCUMENTS

2005/0151813 A1* 7/2005 Ikezaki ..... B41J 2/17513 347/86
2014/0362148 A1* 12/2014 Ishizawa ..... B41J 2/17513 347/86
2018/0104955 A1 4/2018 Kawate et al.

FOREIGN PATENT DOCUMENTS

JP 2018-065373 A 4/2018

* cited by examiner

*Primary Examiner* — Huan H Tran
*Assistant Examiner* — Alexander D Shenderov
(74) *Attorney, Agent, or Firm* — Oliff PLC

(57) ABSTRACT

A liquid housing body includes a bag that is flexible and that houses a liquid therein, a liquid lead-out member that is attached to an end of the bag and that includes a liquid lead-out portion for leading the liquid in the bag to a liquid ejecting apparatus, a spacer member disposed in the bag, and a filter unit that has a thickness smaller than the spacer member, that is disposed between the liquid lead-out member and the spacer member in the bag, and that supplies the liquid to the liquid lead-out member through a filter, in which, in a use state of the liquid housing body, the liquid lead-out member, the filter unit, and the spacer member are aligned in a horizontal direction.

20 Claims, 20 Drawing Sheets

LIQUID HOUSING BODY AND METHOD FOR MANUFACTURING THE SAME

The present application is based on, and claims priority from JP Application Serial Number 2019-058246, filed Mar. 26, 2019, the disclosure of which is hereby incorporated by reference herein in its entirety.

BACKGROUND

1. Technical Field

The present disclosure relates to a liquid housing body.

2. Related Art

With regard to the liquid housing body, for example, JP-A-2018-65373 discloses that, in order to stabilize printing density, a spacer member is disposed in an ink pack that houses ink, and a liquid having a high concentration and containing a large amount of sedimentation components remains in the spacer member.

In addition to stabilizing printing density, the liquid housing body is required to suppress foreign matter or air bubbles generated in the ink pack or mixed in the ink pack from flowing into a liquid ejecting apparatus such as a printer. However, in the technique described in JP-A-2018-65373, the suppression of the inflow of foreign matter or air bubbles has not been sufficiently studied.

SUMMARY

According to an aspect of the present disclosure, a liquid housing body is provided. The liquid housing body includes a bag that is flexible and that houses a liquid therein, a liquid lead-out member that is attached to an end of the bag and that includes a liquid lead-out portion for leading the liquid in the bag to a liquid ejecting apparatus, a spacer member disposed in the bag, and a filter unit that is disposed between the liquid lead-out member and the spacer member in the bag and that supplies the liquid to the liquid lead-out member through a filter, in which, in a use state of the liquid housing body, the liquid lead-out member, the filter unit, and the spacer member are aligned in a horizontal direction.

DESCRIPTION OF EXEMPLARY EMBODIMENTS

A. First Embodiment

Figure 1:
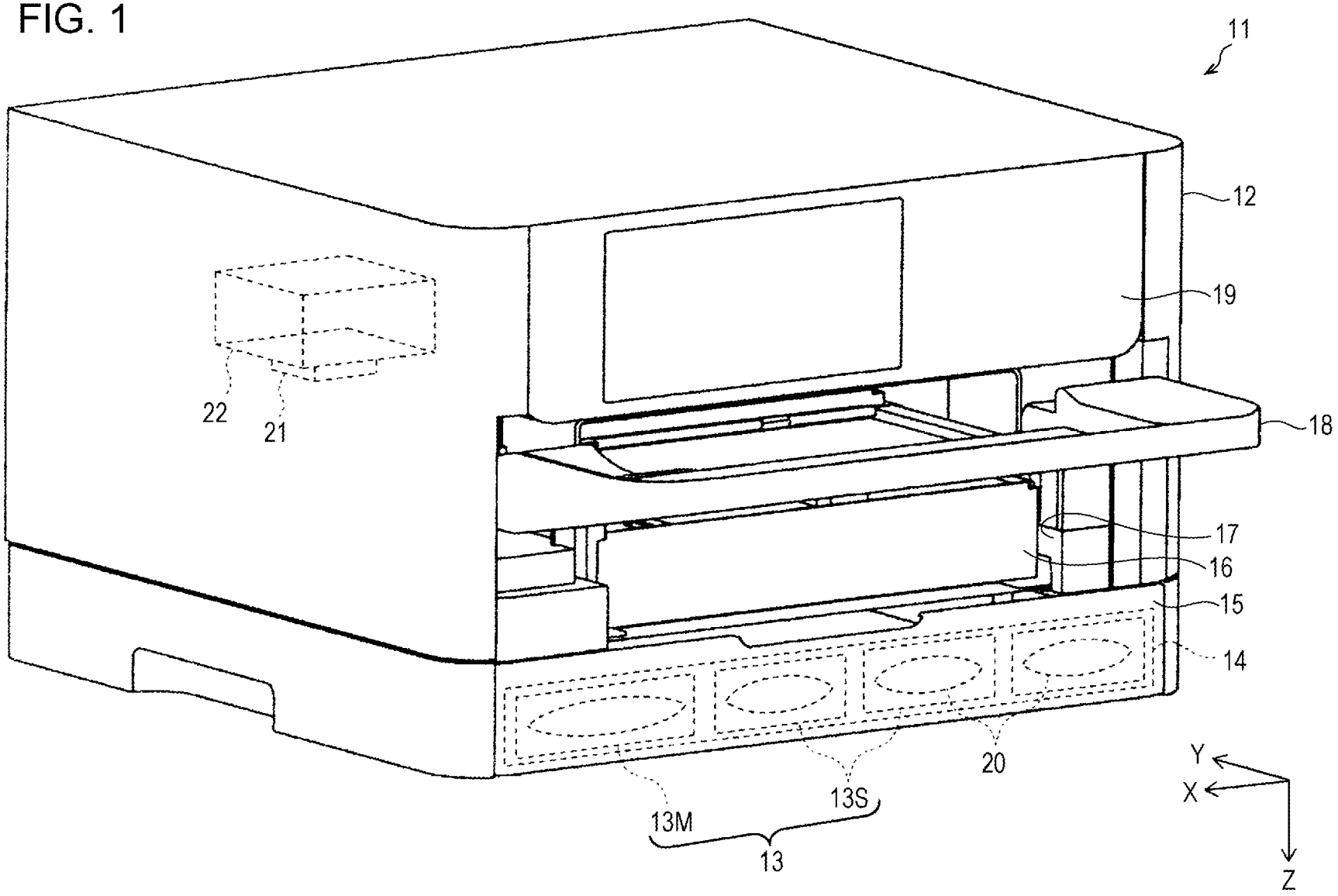
FIG. 1 is a perspective view of a liquid ejecting apparatus.

FIG. 1 is a perspective view of a liquid ejecting apparatus 11. The liquid ejecting apparatus 11 is an ink jet printer that performs printing by ejecting ink, which is an example of a liquid, onto a medium such as paper. The liquid ejecting apparatus 11 includes an exterior body 12 that has a substantially rectangular parallelepiped shape. On a front surface of the exterior body 12, in order from the bottom to the top, a front lid 15 that is pivotable and that covers a mounting portion 14 in which containers 13 are detachably mounted, and a mounting port 17 in which a cassette 16 that can store a medium is mounted are disposed. Furthermore, a discharge tray 18 on which the medium is discharged and an operation panel 19 for operating the liquid ejecting apparatus 11 are arranged above the mounting port 17. Further, the front surface of the exterior body 12 refers to a side surface that has a height and a width and on which operations of the liquid ejecting apparatus 11 are mainly performed.

A plurality of containers 13 can be mounted in the mounting portion 14 of the present embodiment in a manner in which the containers 13 are disposed in the width direction. For example, as the plurality of containers 13, three or more containers 13 including first containers 13S and a second container 13M having a width longer than the first containers 13S can be mounted in the mounting portion 14. Liquid housing bodies 20 are detachably mounted in the containers 13. That is, the liquid housing bodies 20 are placed in the containers 13 that are detachably mounted in the liquid ejecting apparatus 11. The containers 13 can be detachably mounted in the mounting portion 14 even by themselves, which is a state in which the containers 13 do not hold the liquid housing bodies 20, and are components provided to the liquid ejecting apparatus 11. Hereinafter, the state in which the liquid housing bodies 20 are mounted in the liquid ejecting apparatus 11 and used is referred to as the "mounted state" or "use state".

A liquid ejecting portion 21 that ejects the liquid from nozzles and a carriage 22 that reciprocates along a scanning direction that matches a width direction of the liquid ejecting apparatus 11 are provided in the exterior body 12. The liquid ejecting portion 21 moves with the carriage 22 and ejects the liquid supplied from the liquid housing bodies 20 respectively placed in the containers 13 toward the medium for printing on the medium. Further, in another embodiment, the liquid ejecting portion 21 may be a line head, which is fixed at a certain position and does not reciprocate.

In the present embodiment, the width direction is a direction that intersects, preferably that is perpendicular to, a movement path of each of the containers 13 when the container 13 is to be mounted in the mounting portion 14, and the direction in which the movement path extends is a depth direction. In addition, the width direction and the depth direction are substantially along a horizontal plane. In the drawing, the direction of gravity is indicated by a Z axis under the assumption that the exterior body 12 is placed on the horizontal plane, and a movement direction of the container 13 when the container 13 is to be mounted in the mounting portion 14 is indicated by a Y axis. The movement direction may be expressed as a mounting direction in the mounting portion 14 or an insertion direction into a housing space, and a direction opposite to the movement direction may be expressed as a removal direction. In addition, the width direction is indicated by an X axis perpendicular to the Z axis and the Y axis. That is, the width direction, the direction of gravity, and the mounting direction intersect each other, preferably are perpendicular to each other, and are directions for expressing the width, height, and depth, respectively.

Figure 2:
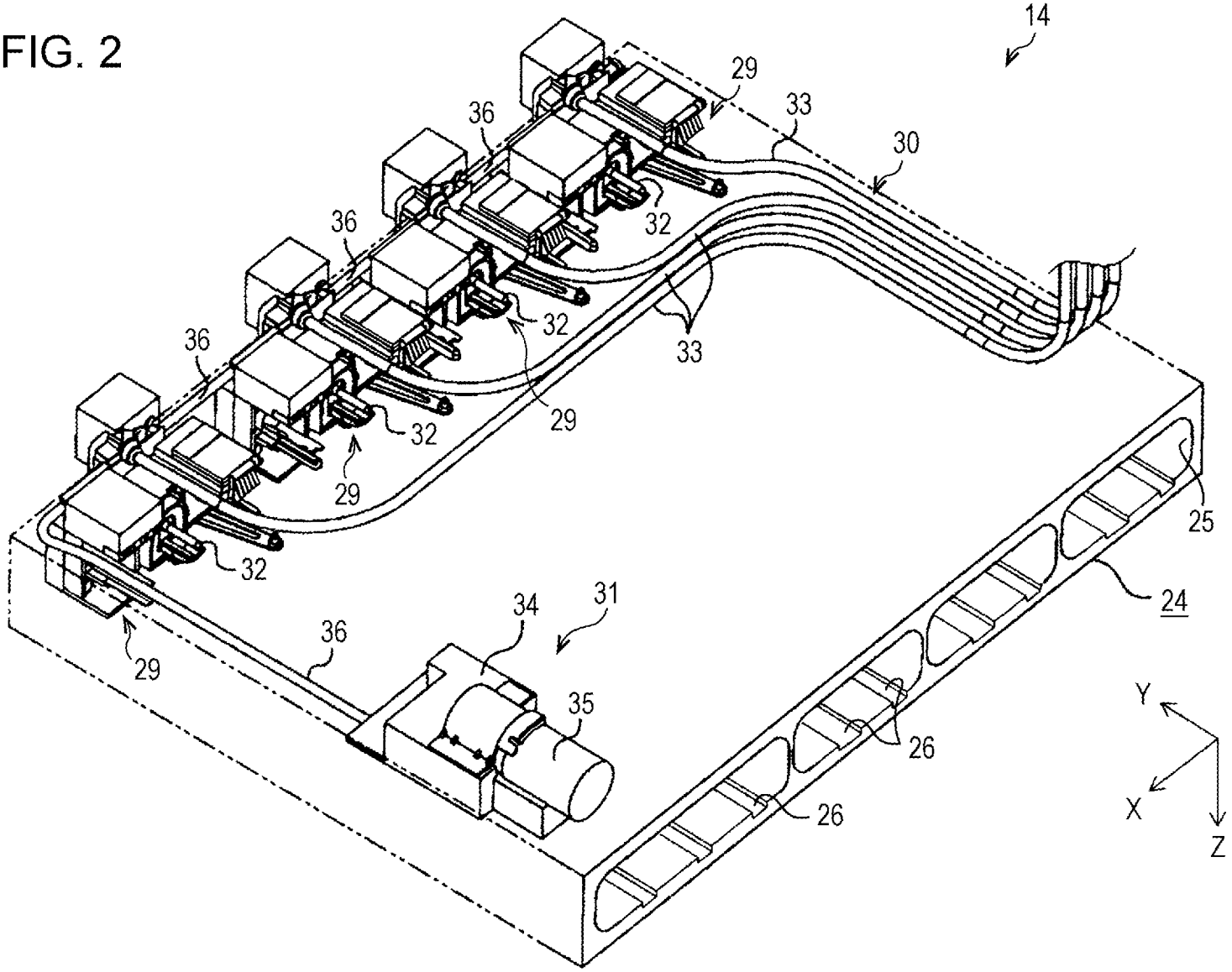
FIG. 2 is a perspective view of a mounting portion.

FIG. 2 is a perspective view of the mounting portion 14. The mounting portion 14 includes a frame body 24 that forms a housing space that can house one or more containers; four in the present embodiment. The frame body 24 has insertion ports 25 that communicate with the housing space from the front side, which is a front lid 15 side. Furthermore, the frame body 24 preferably includes a plurality of linear guide rail pairs each including one or more linear guide rails 26, which have projecting or recessed shapes and extend in the depth direction in order to guide the movement of the containers 13 when attaching and detaching the containers 13.

The containers 13 are inserted into the housing space through the insertion ports 25 and are mounted in the mounting portion 14 by being moved along the movement path that extends toward the depth thereof. Further, in FIG. 2, only the vicinity of a front plate that forms the insertion ports 25 is illustrated by a solid line for the frame body 24. At least one coupling mechanism 29, four in the present embodiment, is provided on the inner side of the housing space so as to individually correspond to the containers 13.

The liquid ejecting apparatus 11 includes supply flow paths 30 that supply liquid from the liquid housing bodies 20 mounted, together with the containers 13, in the mounting portion 14 toward the liquid ejecting portion 21, and a supply mechanism 31 configured to send the liquid housed in the liquid housing bodies 20 to the supply flow paths 30.

Each of the supply flow paths 30 is provided for a corresponding color or type of liquid and includes an ink lead-in needle 32 to which a corresponding one of the liquid housing bodies 20 is to be coupled and a supply tube 33 that is flexible. A pump chamber (not illustrated) is provided between the ink lead-in needle 32 and the supply tube 33. The downstream end of the ink lead-in needle 32 and the upstream end of the supply tube 33 communicate with the pump chamber. The pump chamber is partitioned from a pressure-varying chamber (not illustrated) via a flexible membrane.

The supply mechanism 31 includes a pressure-varying mechanism 34, a drive source 35 for the pressure-varying mechanism 34, and pressure-varying flow paths 36 that couple the pressure-varying mechanism 34 and the pressure-varying chambers to each other. Then, when the pressure-varying mechanism 34 depressurizes each of the pressure-varying chambers via a corresponding one of the pressure-varying flow paths 36 by driving the drive source 35 such as a motor, the flexible membrane is bent and displaced toward the pressure-varying chamber, thereby reducing the pressure in the pump chamber. As the pressure in the pump chamber decreases, the liquid housed in the liquid housing body 20 is sucked into the pump chamber through the ink lead-in needle 32. This is called suction driving. Thereafter, when the pressure-varying mechanism 34 releases the decompression of the pressure-varying chamber through the pressure-varying flow path 36, the flexible membrane is deflected and displaced toward the pump chamber, thereby increasing the pressure in the pump chamber. Then, as the pressure in the pump chamber increases, the liquid in the pump chamber flows out into the supply tube 33 in a pressurized state. This is called ejection driving. Then, the supply mechanism 31 supplies the liquid from the liquid housing body 20 to the liquid ejecting portion 21 by alternately repeating suction driving and ejection driving.

Figure 3:
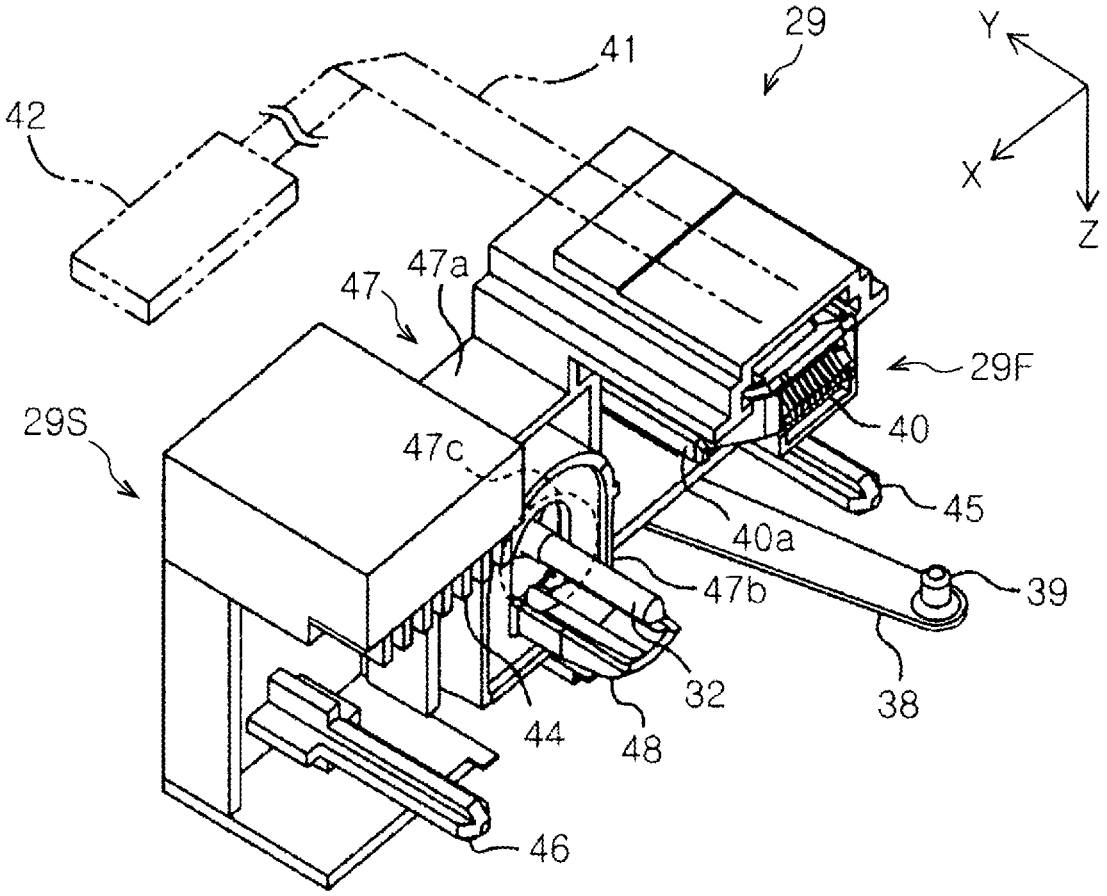
FIG. 3 is a perspective view of a coupling mechanism.

FIG. 3 is a perspective view of the coupling mechanism 29. The coupling mechanism 29 has a first coupling mechanism 29F and a second coupling mechanism 29S at positions that sandwich the ink lead-in needle 32 in the width direction. The first coupling mechanism 29F includes an arm 38 that is disposed vertically below the ink lead-in needle 32 and that protrudes in a removal direction. A locking portion 39 is provided at a distal end of the arm 38. The arm 38 is configured such that the distal end side is pivotable about a base end side. The locking portion 39, for example, protrudes vertically upward from the arm 38, and is arranged in the movement path of the container 13 when the container 13 is to be mounted in the mounting portion 14. When the container 13 is mounted in the mounting portion 14, the locking portion 39 fits into an engagement groove 78 provided on a rear surface of the container 13, and the container 13 is restricted from being easily detached from the mounting portion 14.

The first coupling mechanism 29F includes a terminal portion 40 that is disposed vertically above the ink lead-in needle 32 and protrudes in the removal direction. The terminal portion 40 is coupled to a control device 42 via an electric line 41 such as a flat cable. The terminal portion 40 is preferably disposed so that an upper end thereof protrudes in the removal direction relative to the lower end and faces obliquely downward. In addition, it is preferable to dispose a pair of guide projecting portions 40*a* that protrude in the width direction and extend in the mounting direction on both width-direction sides of the terminal portion 40.

The second coupling mechanism 29S is preferably provided with a block 44 for suppressing erroneous insertion, which is disposed vertically above the ink lead-in needle 32 and protrudes in the removal direction. The block 44 has an uneven shape disposed facing downward. The shape of the unevenness differs for each of the coupling mechanisms 29.

The coupling mechanism 29 includes a pair of positioning protrusions 45 and 46 and an extrusion mechanism 47 disposed so as to surround the ink lead-in needle 32, and a liquid receiving portion 48 that protrudes in the removal direction below the ink lead-in needle 32. The pair of positioning protrusions 45 and 46 are arranged in the width direction with the ink lead-in needle 32 interposed therebetween and so as to be included in the first coupling mechanism 29F and the second coupling mechanism 29S, respectively. The positioning protrusions 45 and 46 may be, for example, rod-like protrusions that are parallel to each other and protrude in the removal direction. It is preferable that the protruding length of the positioning protrusions 45 and 46 in the removal direction be longer than the protruding length of the ink lead-in needle 32 in the removal direction.

The extrusion mechanism 47 includes a frame member 47*a* that surrounds a base end portion of the ink lead-in needle 32, a pressing portion 47*b* that protrudes from the frame member 47*a* in the removal direction, and an urging portion 47*c* that urges the container 13 in the removal direction via the pressing portion 47*b*. The urging portion 47*c* can be, for example, a coil spring interposed between the frame member 47*a* and the pressing portion 47*b*.

Figure 4:
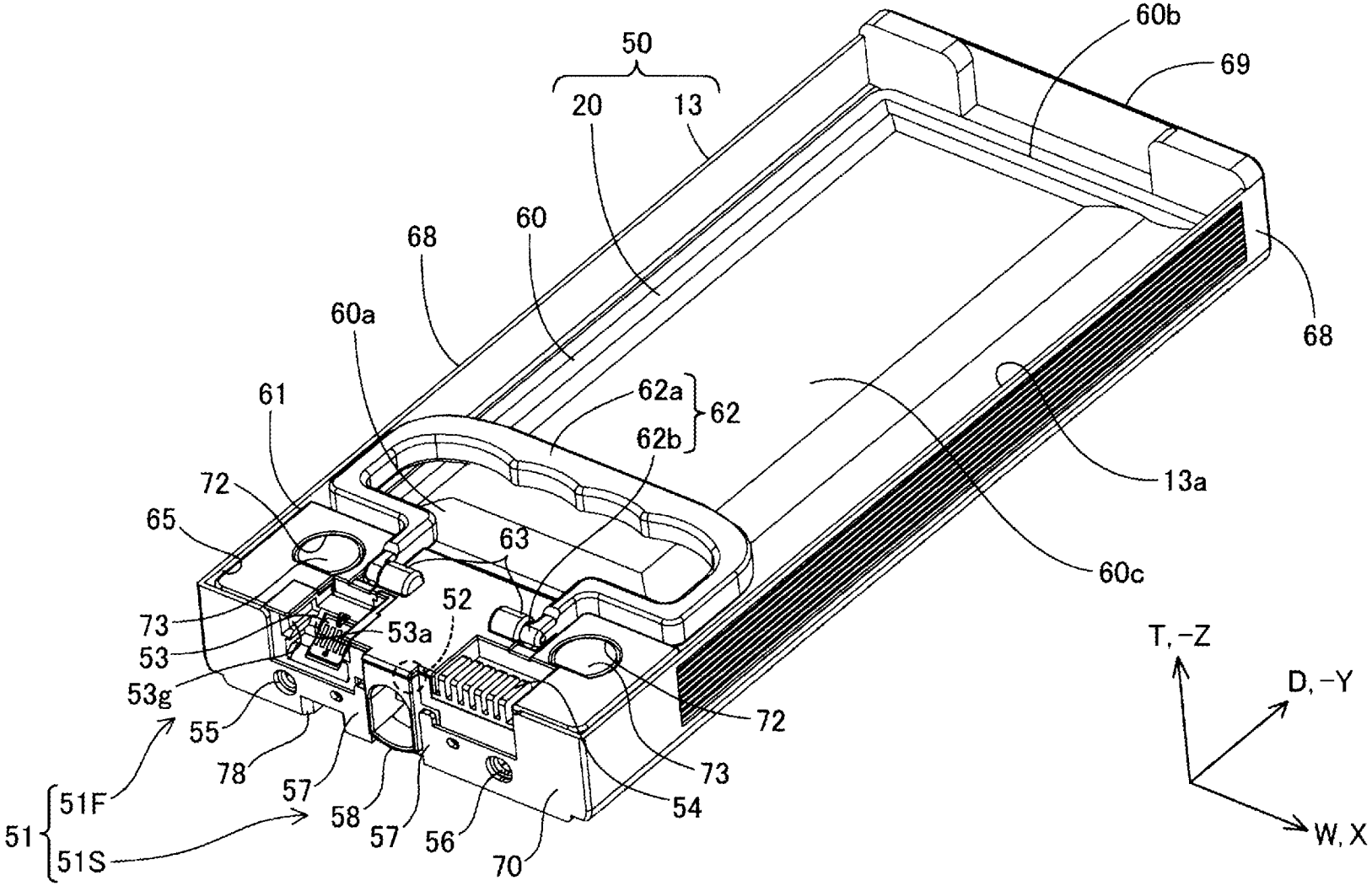
FIG. 4 is a perspective view of a mounting body mounted in the mounting portion.
Figure 5:
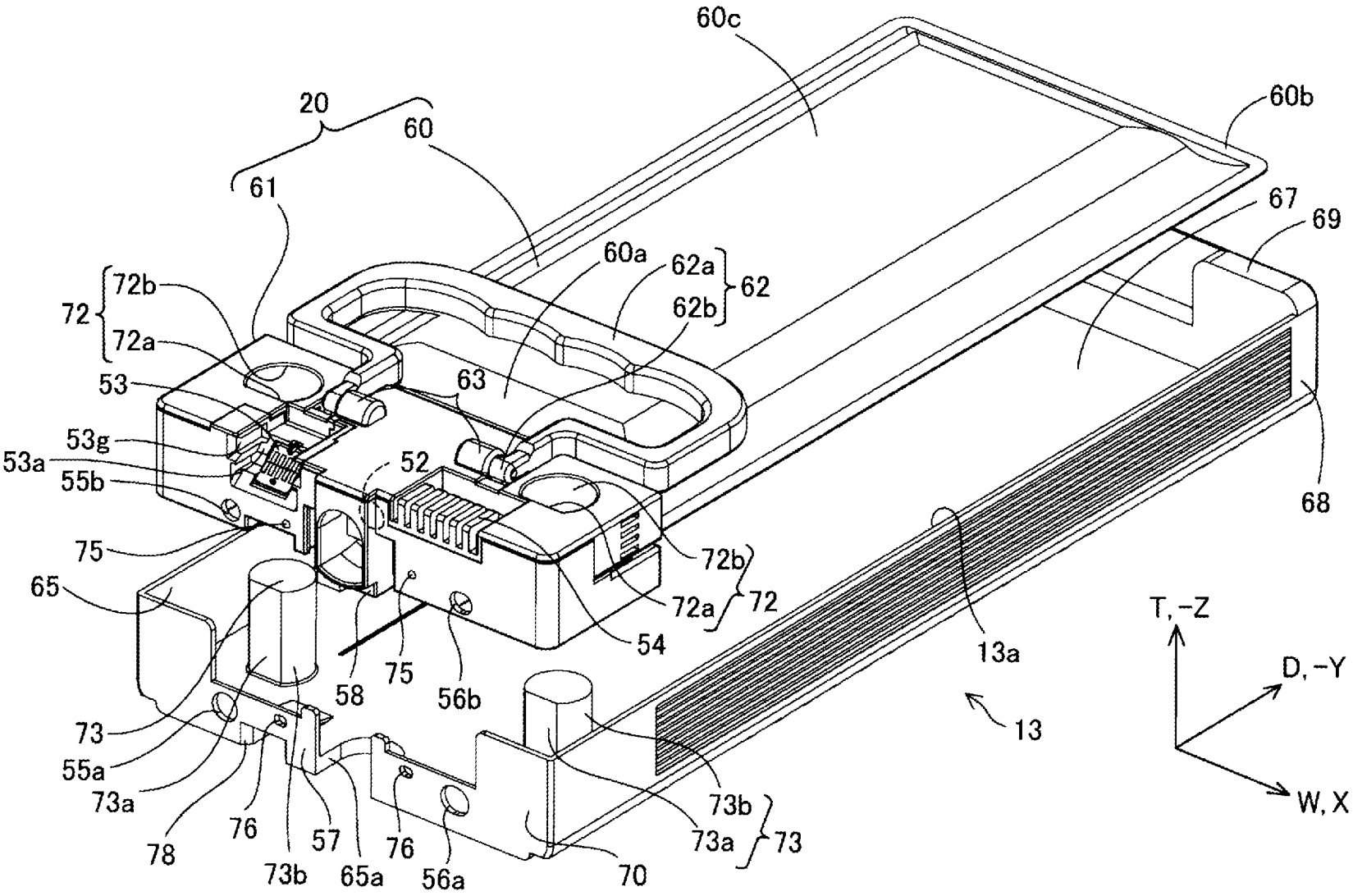
FIG. 5 is a perspective view of a liquid housing body and a container forming the mounting body.

FIG. 4 is a perspective view of a mounting body 50 to be mounted in the mounting portion 14. In the present embodiment, the mounting body 50 includes the container 13 having a substantially rectangular parallelepiped outer shape and the liquid housing body 20 placed in the container 13. In FIG. 4 and FIG. 5 described later, a perspective view of the second container 13M is illustrated as the container 13. Further, the first containers 13S and the second container 13M, and the liquid housing bodies 20 placed in the first containers 13S and the second container 13M, are different only in size in the width direction, and have the same structure.

The liquid housing body 20 is for supplying a liquid having a sedimentation component to the liquid ejecting apparatus 11. The liquid housing body 20 includes a bag 60 and an adapter 61. The bag 60 has flexibility. The bag 60 may have a pillow type shape or a gusset type shape. The bag 60 of the present embodiment is a pillow type bag formed by stacking two rectangular films and joining the peripheral portions thereof to each other. The film forming the bag 60 is formed of a material having flexibility and gas barrier properties. For example, examples of the film material include polyethylene terephthalate (PET), nylon, and polyethylene. In addition, a film may be formed using a multi-layer structure in which multiple films composed of these raw materials are stacked. In such a multi-layer structure, for example, the outer layer may be formed of PET or nylon excellent in terms of impact resistance, and the inner layer may be formed of polyethylene excellent in terms of ink resistance. Furthermore, a film having a layer on which aluminum or the like has been deposited may be used as one constituent member of the multi-layer structure.

The bag 60 is provided with a liquid housing portion 60*c* for housing a liquid therein. The liquid housing portion 60*c* houses, as a liquid, ink in which a pigment as a sedimentation component is dispersed in a solvent. The bag 60 has one end 60*a* and another end 60*b* opposite to the one end 60*a*. The adapter 61 is attached to the one end 60*a* of the bag 60. The adapter 61 includes a liquid lead-out portion 52 for leading the liquid in the liquid housing portion 60*c* to the liquid ejecting apparatus 11. The liquid lead-out portion 52 can also be referred to as the "supply port".

FIG. 4 illustrates three directions perpendicular to each other, that is, the D direction, the T direction, and the W direction. In the present embodiment, the D direction is a direction along the Y direction illustrated in FIG. 1 and is a direction in which the bag 60 extends. In the following description, the direction from the liquid lead-out portion 52 to the other end 60*b* of the bag 60 in the D direction is defined as the +D direction, and the direction opposite to the +D direction is defined as the −D direction. In addition, the direction with the smallest dimension among the external dimension of the liquid housing body 20 is defined as the T direction. A direction perpendicular to the D direction and the T direction is defined as the W direction. In the present embodiment, the T direction is a direction along the Z direction, and the +T direction corresponds to the −Z direction. In addition, the W direction is a direction along the X direction, and the +W direction corresponds to the +X direction. In the present embodiment, the T direction is the thickness direction of the bag 60. In the following, the term "upward" simply refers to the +T direction in the mounted state, and the term "downward" simply refers to the −T direction in the mounted state.

The mounting body 50 includes a coupling structure 51 at a distal end, with the end, toward which the mounting body 50 advances when mounted in the mounting portion 14 illustrated in FIG. 2, being the distal end and the end opposite to the distal end being the base end. The coupling structure 51 includes a first coupling structure 51F and a second coupling structure 51S on both sides of the liquid lead-out portion 52 in the width direction.

The first coupling structure 51F includes a coupling terminal 53 that is disposed vertically above the liquid lead-out portion 52. The coupling terminal 53 is provided, for example, on the surface of a circuit board, and the circuit board includes a storage unit that stores various types of information regarding the liquid housing body 20. The information related to the liquid housing body 20 includes, for example, information indicating the type of the liquid housing body 20, the amount of liquid housed, and the like.

The coupling terminal 53 is preferably arranged so as to face obliquely upward in a recessed portion 53*a* provided to open upward and in the mounting direction. In addition, it is preferable to arrange guide recessed portions 53*g* extending in the mounting direction on both width-direction sides of the coupling terminal 53.

The second coupling structure 51S preferably includes an identification portion 54 for suppressing erroneous insertion, which is disposed vertically above the liquid lead-out portion 52. The identification portion 54 has an uneven shape that meshes with the block 44 of the corresponding coupling mechanism 29 illustrated in FIG. 3.

The coupling structure 51 includes a first positioning hole 55 and a second positioning hole 56 constituting a pair, an urge receiving portion 57 that receives an urging force of the urging portion 47*c* illustrated in FIG. 3, and an insertion portion 58 that extends below the liquid lead-out portion 52. The first and second positioning holes 55 and 56 are arranged in the width direction with the liquid lead-out portion 52 interposed therebetween so as to be included in the first coupling structure 51F and the second coupling structure 51S, respectively. It is preferable that the second positioning hole 56 included in the second coupling structure 51S be a substantially elliptical long hole that is elongated in the width direction, while the first positioning hole 55 included in the first coupling structure 51F be a circular hole.

FIG. 5 is a perspective view of the liquid housing body 20 and the container 13 forming the mounting body 50. A notch 65*a* that engages with the insertion portion 58 provided in the adapter 61 of the liquid housing body 20 is formed at the distal end of the container 13. Furthermore, a first hole 55*a* and a second hole 56*a* are formed on both width-direction sides of the notch 65*a*, and a first hole 55*b* and a second hole 56*b* are formed at the distal end of the adapter 61. When the liquid housing body 20 is placed in the container 13, the first holes 55*a* and 55*b* and the second holes 56*a* and 56*b* are arranged in the depth direction, respectively, and the first holes 55*a* and 55*b* constitute the first positioning hole 55, and the second holes 56*a* and 56*b* constitute the second positioning hole 56.

The adapter 61 includes a handle portion 62. The handle portion 62 is formed of a member different from the adapter 61 and is movable with respect to the adapter 61. Specifically, the handle portion 62 can be moved by pivoting around a pivot shaft 63 provided on the adapter 61. The pivot shaft 63 is formed so as to open on both width-direction sides, and a bottomed semi-cylindrical portion protrudes from the upper surface of the adapter 61.

The handle portion 62 has a grip portion 62*a* to be gripped by the user. The grip portion 62*a* is located closer to the bag 60 side away from the adapter 61 in the depth direction than a shaft portion 62*b* supported by the pivot shaft 63. The handle portion 62 is pivotable between a first orientation in which the grip portion 62*a* and the pivot shaft 63 are located at the same height or a position where the grip portion 62*a* is lower than the pivot shaft 63, and a second orientation in which the grip portion 62*a* is located at a position higher than the pivot shaft 63.

The container 13, at a distal end, has an engagement receiving portion 65 with which the adapter 61 of the liquid housing body 20 can be engaged. The adapter 61 includes the coupling terminal 53, the recessed portion 53*a*, a guide recessed portion 53*g*, the identification portion 54, the first hole 55*b*, and the second hole 56*b*. The engagement receiving portion 65 of the container 13 includes the urge receiving portion 57, the first hole 55*a*, and the second hole 56*a*. The adapter 61 is located at the distal end of the container 13 when engaged with the engagement receiving portion 65.

The container 13 includes a bottom plate 67 forming a bottom surface, side plates 68 erected vertically from both width-direction ends of the bottom plate 67, a front plate 69 erected vertically upward from a base end of the bottom plate 67, and a head plate 70 erected vertically upward from a distal end of the bottom plate 67.

In the container 13, the bottom plate 67, the side plates 68, the front plate 69, and the head plate 70 constitute a main body that forms a storage space for storing the liquid housing body 20. The container 13 has an opening 13*a* for taking in and out the liquid housing body 20 to and from the storage space. In the present embodiment, the opening 13*a* of the container 13 opens upward in the vertical direction, which is a direction different from the mounting direction in which the container 13 advances when being mounted in the mounting portion 14.

The adapter 61 is provided with a plurality of to-be-guided portions 72 that are substantially round-hole-shaped and formed so as to penetrate in the guiding direction. In the present embodiment, two to-be-guided portions 72 are formed so as to be aligned in the width direction.

In addition, the engagement receiving portion 65 of the container 13 is provided with a plurality of guiding portions 73 that are substantially cylindrical and that protrude from the bottom plate 67 in the guiding direction. In the present embodiment, two guiding portions 73 are formed so as to be aligned in the width direction. Further, the guiding direction is a direction that intersects, preferably that is perpendicular to, the bottom plate 67 or the opening 13*a* and is along the side plates 68. In the present embodiment, the guiding direction is along the T direction.

The guiding portions 73 provided in the container 13 guide the to-be-guided portions 72 provided in the adapter 61 in the guiding direction. On the other hand, the to-be-guided portions 72 provided in the adapter 61 are guided in the guiding direction by the guiding portions 73 provided in the container 13.

In the present embodiment, each of the guiding portions 73 has a projecting shape that is substantially semi-cylindrical, and the side surface of the guiding portion 73 along the guiding direction has a restricting portion 73*a* that is flat and that is located on the distal end side, and a curved surface portion 73*b* on the base end side with respect to the restricting portion 73*a*.

The to-be-guided portions 72 are each formed in a shape that has a restricting portion 72*a* and a curved surface portion 72*b* so as to follow the shape of the guiding portions 73. The restricting portions 72*a* and 73*a* restrict deviation and rotation of the liquid housing body 20 placed in the container 13.

Furthermore, for example, protruding portions 75 that are dome-shaped and that have a chamfered corner at least in the guiding direction are formed on a distal end surface of the adapter 61. In addition, the head plate 70 of the container 13 is formed with engagement holes 76 that engage with the protruding portions 75. In this way, when the liquid housing body 20 is placed in the container 13, it is possible to give the user a sensation or feeling like a click feeling that the engagement between the container 13 and the liquid housing body 20 has been completed. The protruding portions 75 and the engagement holes 76 of the present embodiment are formed so as to be arranged in pairs on both width-direction sides of the liquid lead-out portion 52 and the notch 65*a* of the container 13 therebetween.

Here, with reference to FIG. 3 and FIG. 4, the coupling of the coupling structure 51 included in the mounting body 50 to the coupling mechanism 29 is demonstrated. When the mounting body 50 is inserted into the housing space and the distal end approaches the coupling mechanism 29, first, distal ends of the positioning protrusions 45 and 46 having a long protruding length in the removal direction are inserted into and engaged with the first and second positioning holes 55 and 56 of the mounting body 50, thereby restricting the movement of the mounting body 50 in the width direction. Since the second positioning hole 56 is an elliptical elongated hole extending in the width direction, the positioning protrusion 45 inserted into the first positioning hole 55, which is circular, becomes a reference for positioning.

After the positioning protrusions 45 and 46 are engaged with the first and second positioning holes 55 and 56, when the mounting body 50 further advances in depth, the urge receiving portion 57 contacts the pressing portion 47*b* and receives the urging force of the urging portion 47*c*, and the liquid lead-out portion 52 of the liquid housing body 20 is coupled to the ink lead-in needle 32. When the liquid housing body 20 is new, a film is welded to a distal end of the liquid lead-out portion 52, and this film is broken by the ink lead-in needle 32. The positioning protrusions 45 and 46 preferably position the mounting body 50 before the ink lead-in needle 32 is coupled to the liquid lead-out portion 52.

When the mounting body 50 is inserted at the correct position, the identification portion 54 appropriately fits into the block 44 of the coupling mechanism 29. On the other hand, if the mounting body 50 is to be mounted at the wrong position, because the identification portion 54 does not fit into the block 44, the mounting body 50 cannot proceed further and erroneous mounting is suppressed.

In addition, when the mounting body 50 advances in the mounting direction, the terminal portion 40 enters the recessed portion 53*a* of the mounting body 50, the position of the mounting body 50 is adjusted by the guide recessed portion 53*g* being guided by the guide projecting portion 40*a*, and the terminal portion 40 comes into contact with the coupling terminal 53. As a result, the coupling terminal 53 is electrically coupled to the terminal portion 40, and information is exchanged between the circuit board and the control device 42. As described above, it is preferable to dispose the first positioning hole 55 as a positioning reference on the first coupling structure 51F including the coupling terminal 53, out of the first coupling structure 51F and the second coupling structure 51S.

When the liquid lead-out portion 52 of the liquid housing body 20 is coupled in a state where the liquid can be supplied to the ink lead-in needle 32, and the coupling terminal 53 comes into contact with the terminal portion 40 and is electrically coupled thereto, the coupling of the coupling structure 51 to the coupling mechanism 29 is completed.

Figure 6:
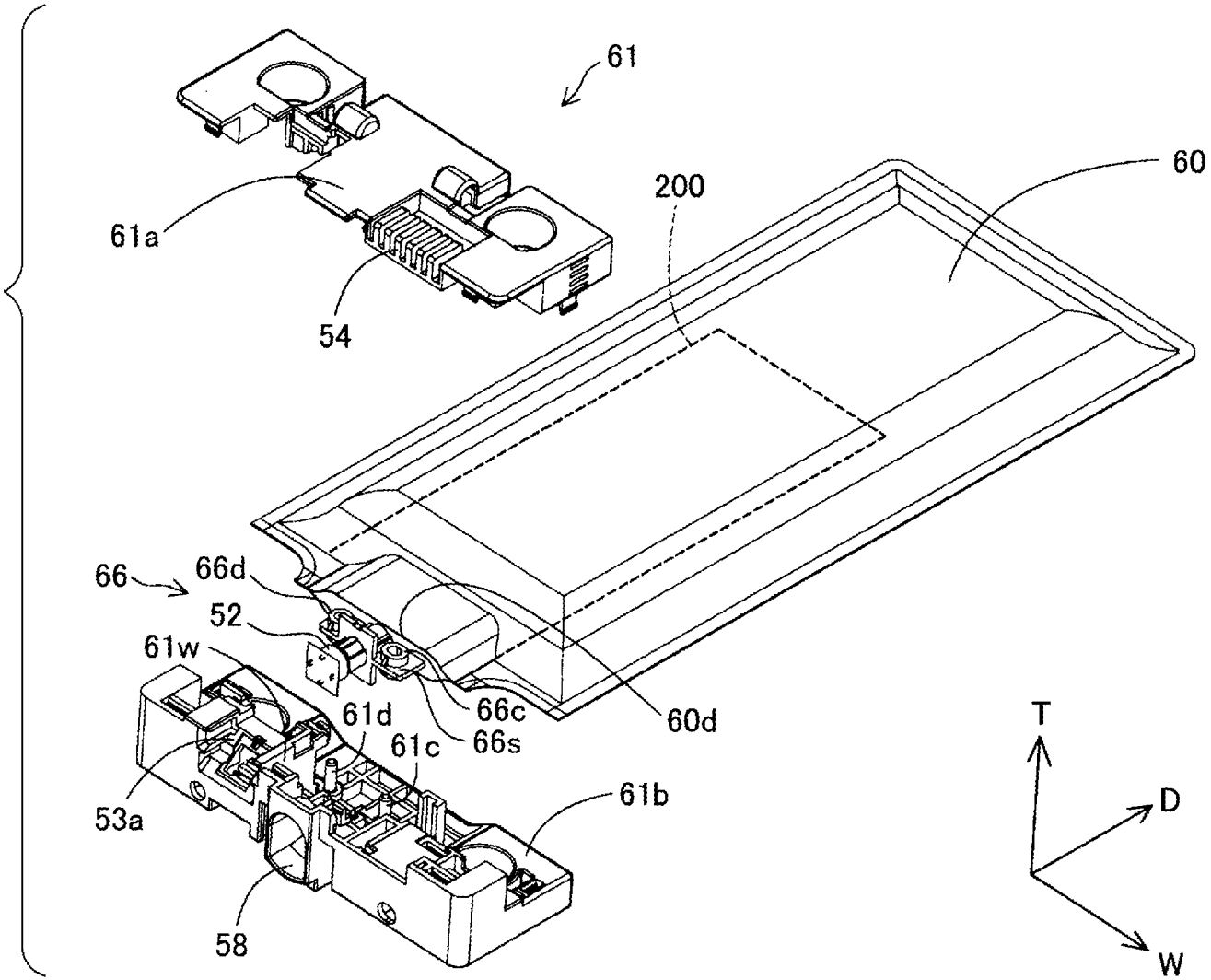
FIG. 6 is an exploded perspective view of an adapter.

FIG. 6 is an exploded perspective view of the adapter 61. The adapter 61 can be divided in the T direction, and includes a lid member 61*a* and a bottom member 61*b*. The identification portion 54 is mainly formed on the lid member 61*a*. The insertion portion 58 and the recessed portion 53*a* are mainly formed in the bottom member 61*b*. An internal structure 200 is disposed inside the bag 60. A portion of a liquid lead-out member 66 that forms a portion of the internal structure 200 is exposed from a −D direction end of the bag 60. The exposed portion of the liquid lead-out member 66 is provided with the liquid lead-out portion 52 and a fixing portion 66*s*.

In the present embodiment, the bottom member 61*b* is provided with a first protrusion 61*c* and a second protrusion 61*d* in the +T direction. The first protrusion 61*c* and the second protrusion 61*d* are provided at positions sandwiching the insertion portion 58 in the W direction. The fixing portion 66*s* is provided with a first through hole 66*c* and a second through hole 66*d* at positions sandwiching the liquid lead-out portion 52 from the width direction. The first protrusion 61*c* is inserted into the first through hole 66*c*, and the second protrusion 61*d* is inserted into the second through hole 66*d*. By sandwiching the fixing portion 66*s* from the +T direction side and the −T direction side by the lid member 61*a* and the bottom member 61*b*, a portion of a −D direction end of the bag 60 is sandwiched between the lid member 61*a* and the bottom member 61*b* together with the fixing portion 66*s*, and the bag 60 is fixed to the adapter 61.

Figure 7:
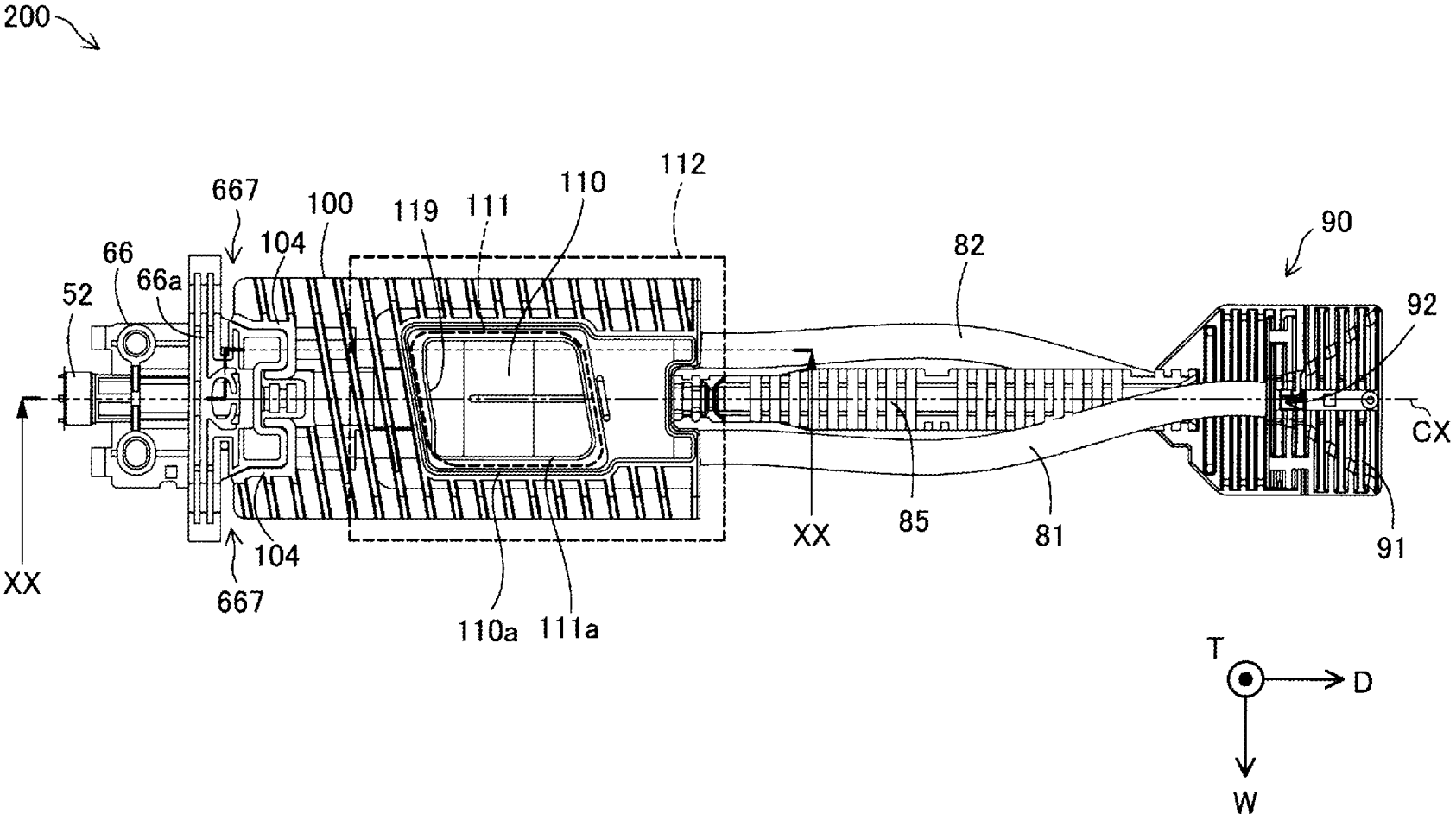
FIG. 7 is a plan view of an internal structure.
Figure 8:
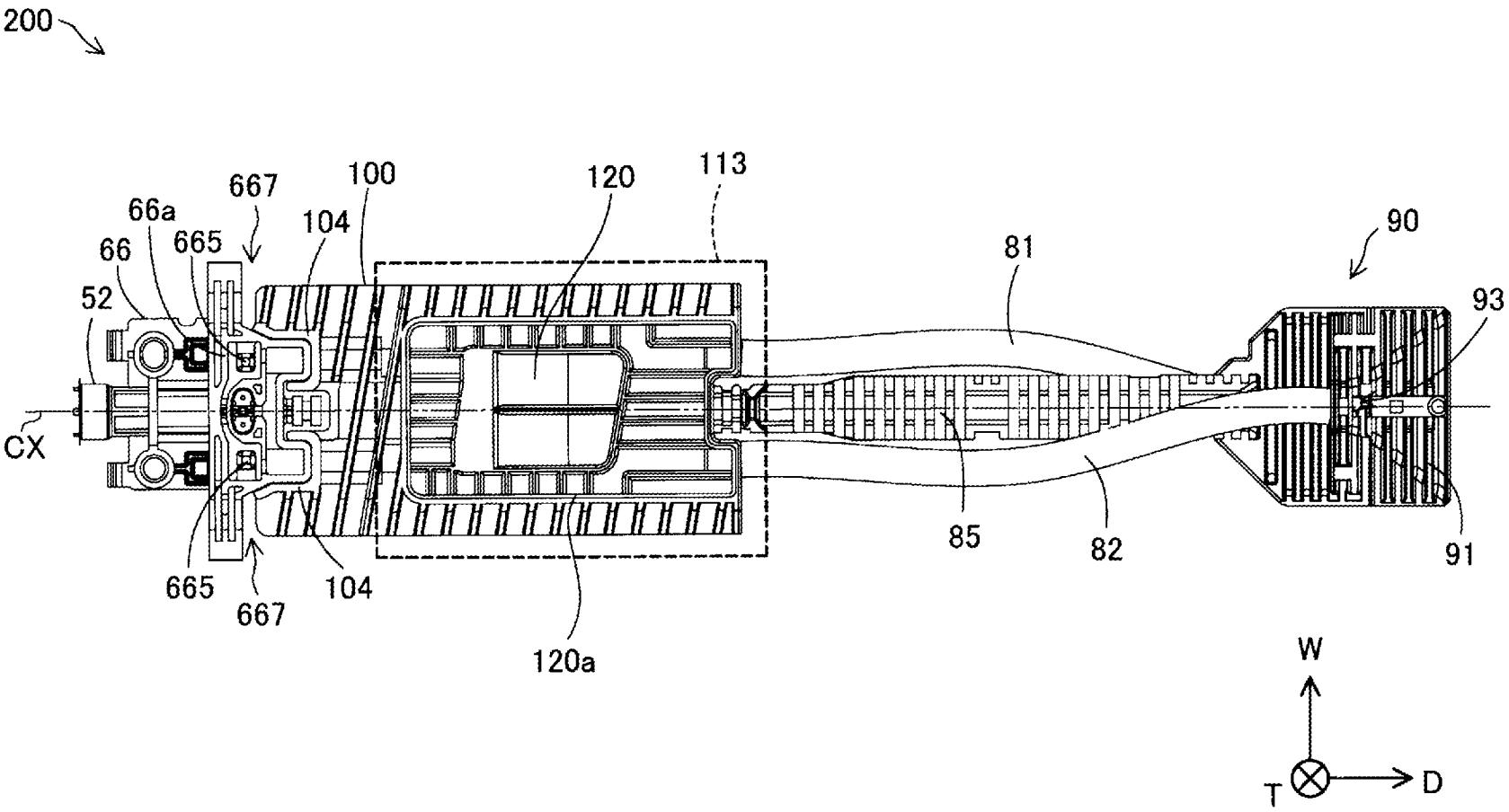
FIG. 8 is a bottom view of the internal structure.
Figure 9:
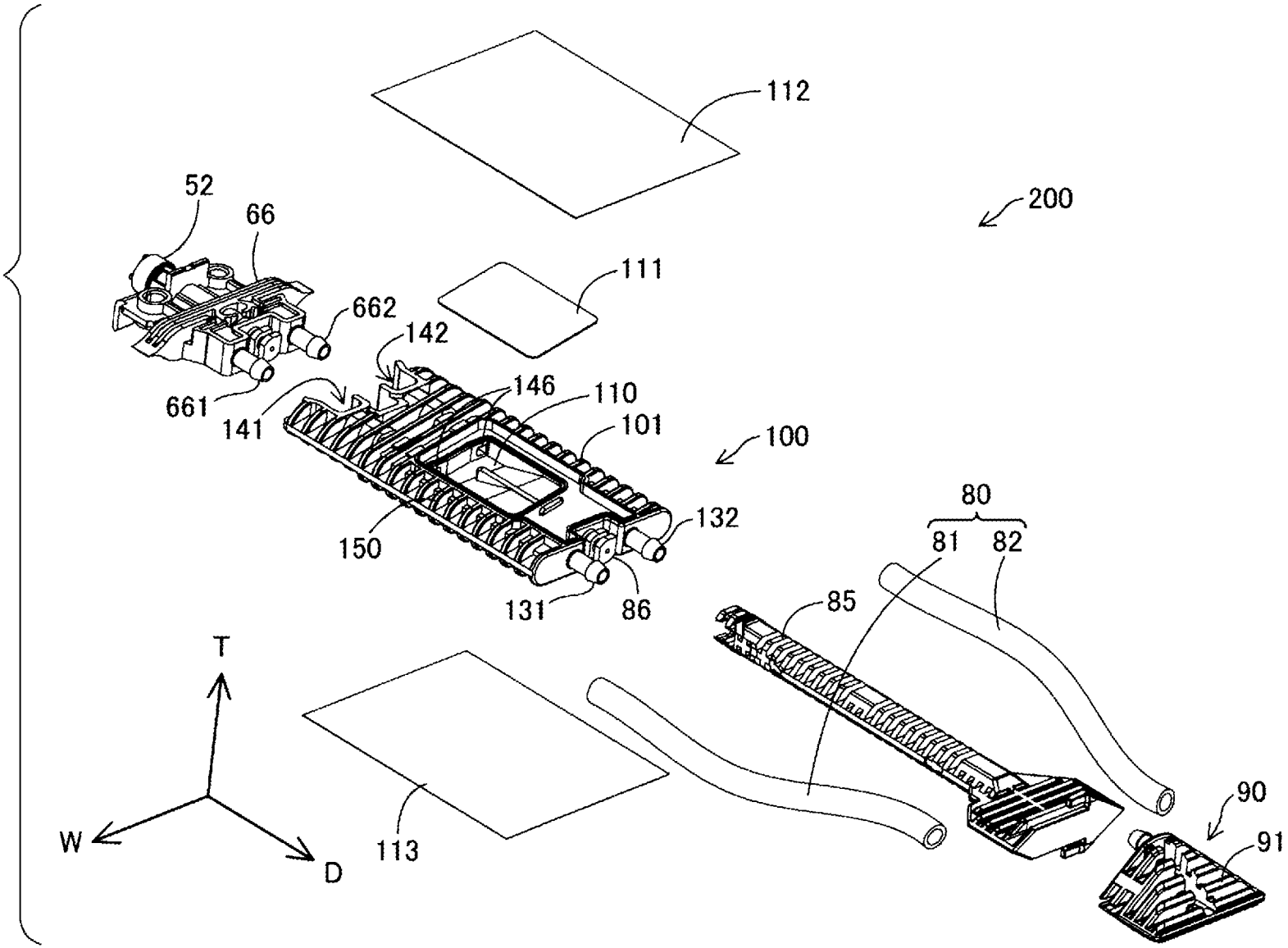
FIG. 9 is an exploded perspective view of the internal structure.
Figure 10:
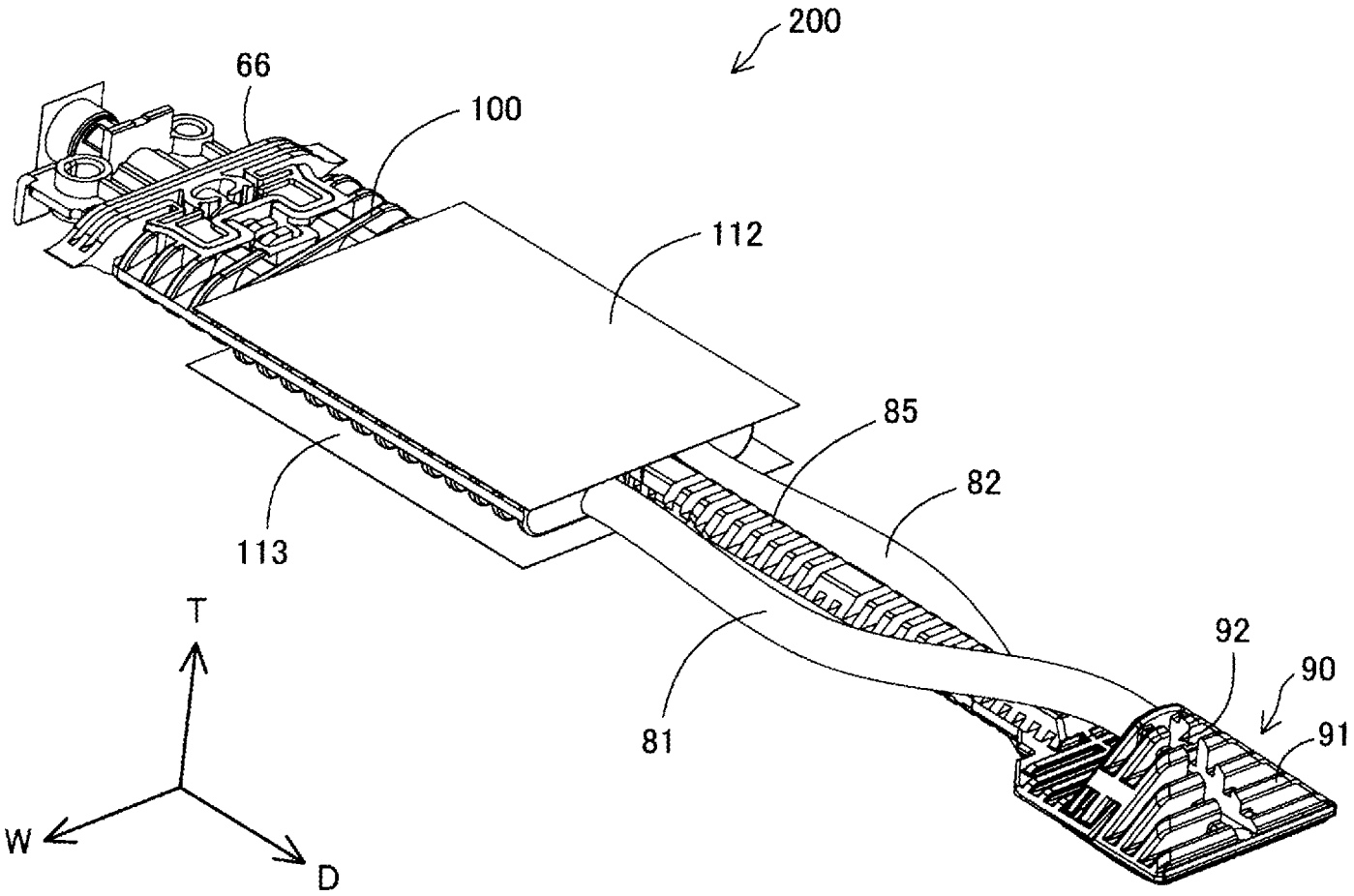
FIG. 10 is a first perspective view of the internal structure.
Figure 11:
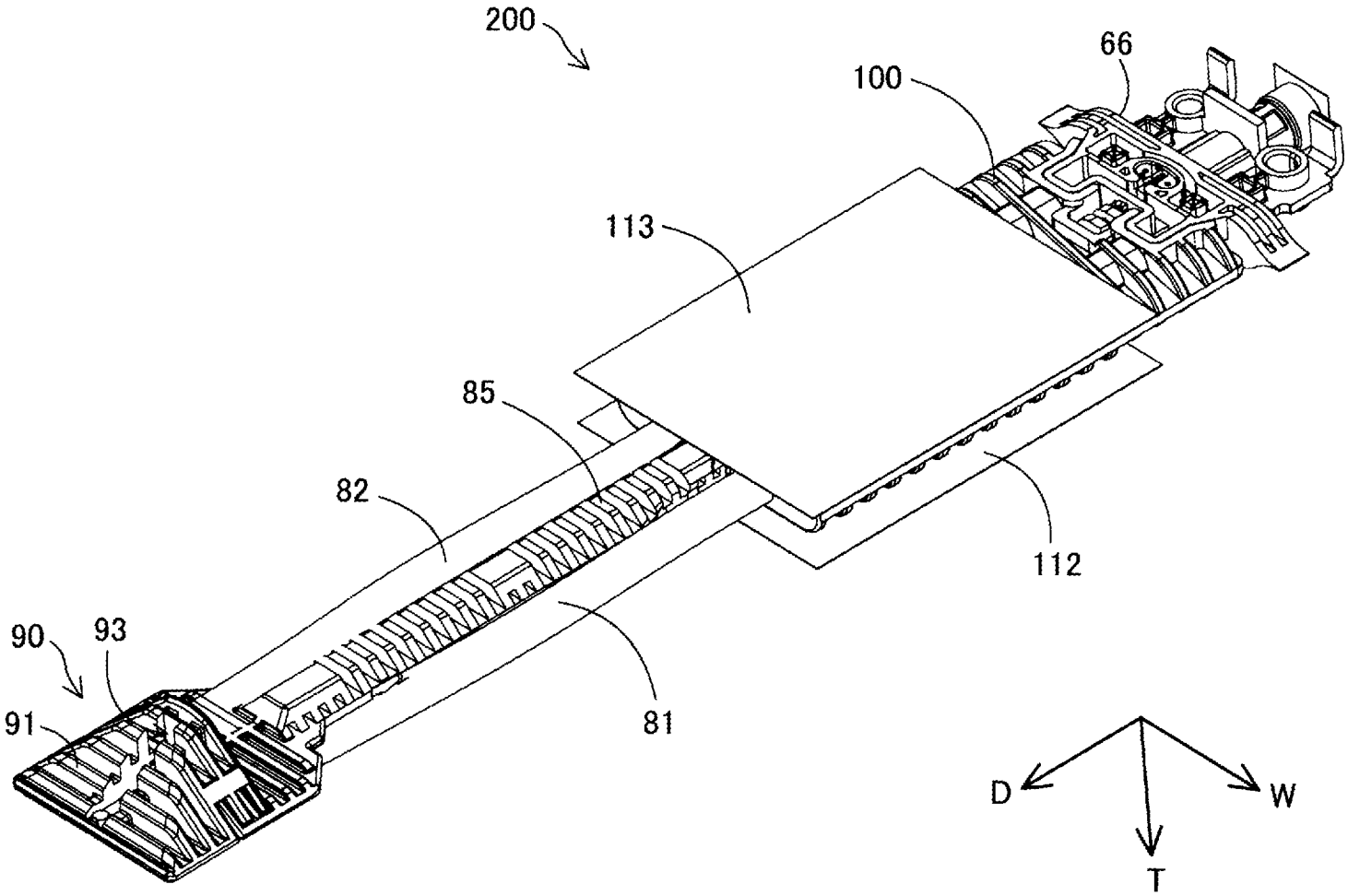
FIG. 11 is a second perspective view of the internal structure.

FIG. 7 is a plan view of the internal structure 200. FIG. 8 is a bottom view of the internal structure 200. FIG. 9 is an exploded perspective view of the internal structure 200. FIG. 10 is a first perspective view of the internal structure 200. FIG. 11 is a second perspective view of the internal structure 200.

As illustrated in FIGS. 7 and 8, the internal structure 200 includes the liquid lead-out member 66, a spacer member 90, and a filter unit 100. When the liquid housing body 20 is in use, the liquid lead-out member 66, the filter unit 100, and the spacer member 90 are aligned in a horizontal direction.

The liquid lead-out member 66 is a member that is attached to one end 60*a* of the bag 60 and includes the liquid lead-out portion 52 for leading the liquid in the bag 60 to the liquid ejecting apparatus 11. The liquid lead-out member 66 includes a weld portion 66*a* to which an opening 60*d* of the bag 60 is welded. The weld portion 66*a* includes a portion having the largest outer periphery in the liquid lead-out member 66.

As illustrated in FIG. 8, the liquid lead-out member 66 is provided with liquid inlets 665 that open only when liquid is injected. The liquid inlets 665 communicate with the flow path in the liquid lead-out portion 52. The liquid inlets 665 are used for injecting the liquid into the bag 60 in the manufacturing process of the liquid housing body 20. The liquid inlets 665 are blocked by completely welding the bag 60 to the weld portion 66*a* after the liquid is injected. Each of the liquid inlets 665 is also referred to as the "bypass flow path".

As illustrated in FIG. 9, two first projecting portions 661 and 662, which are cylindrical, are provided at a +D direction end of the liquid lead-out member 66. The internal spaces of the first projecting portions 661 and 662 communicate with the internal space of the liquid lead-out portion 52. The first projecting portions 661 and 662 are press-fitted into recessed portions 141 and 142 provided in the vicinity of a −D direction end of the filter unit 100.

The spacer member 90 is a structure for defining a region having a constant volume inside the bag 60. The spacer member 90 restricts shrinkage of the bag 60 in the thickness direction. The spacer member 90 is formed of, for example, a synthetic resin such as polyethylene or polypropylene. The spacer member 90 is provided at a position that intersects the TD plane passing through the center axis CX of the liquid lead-out portion 52 in the liquid housing portion 60*c*. The TD plane is a plane including the T direction and the D direction.

The spacer member 90 has surfaces 91 on the +T direction side that are inclined so that the dimension along the T direction increases from the +D direction side toward the −D direction side. Hereinafter, the surfaces 91 are referred to as the "inclined surfaces 91". In the present embodiment, the spacer member 90 has the inclined surfaces 91 on the +T direction side and the −T direction side of the center axis CX. Therefore, the spacer member 90 has a sharp shape toward the +D direction when viewed from the W direction. In the present embodiment, the inclined surfaces 91 are formed with grooves along the D direction and the W direction. Further, in the present embodiment, the term "surface" includes not only a surface composed of only a flat surface, but also a surface with grooves or recessed portions formed on the surface, a surface with protrusions or projecting portions formed on the surface, and a virtual surface surrounded by a frame. That is, as long as it can be grasped as a "surface" on the whole, there may be irregularities and through holes in a certain region occupied by the surface.

As illustrated in FIGS. 7 to 11, the spacer member 90 includes a first lead-in port 92 on the +T direction side of the center axis CX, and a second lead-in port 93 on the −T direction side of the center axis CX. The first lead-in port 92 and the second lead-in port 93 are formed so as to fit into the grooves formed in the inclined surfaces 91. The first lead-in port 92 and the second lead-in port 93 are inlets for leading the liquid in the liquid housing portion 60*c* to the outside. The first lead-in port 92 is disposed on the +T direction side of the second lead-in port 93. Therefore, the liquid on the relatively upper side of the liquid housing portion 60*c* flows from the first lead-in port 92, and the liquid on the relatively lower side of the liquid housing portion 60*c* flows from the second lead-in port 93.

The spacer member 90 is coupled to a +D direction end of the filter unit 100 by a coupling member 85 that is rod-like. As illustrated in FIG. 9, a −D direction end of the coupling member 85 is locked to a locking portion 86 provided on the +D direction surface of the filter unit 100.

Figure 12:
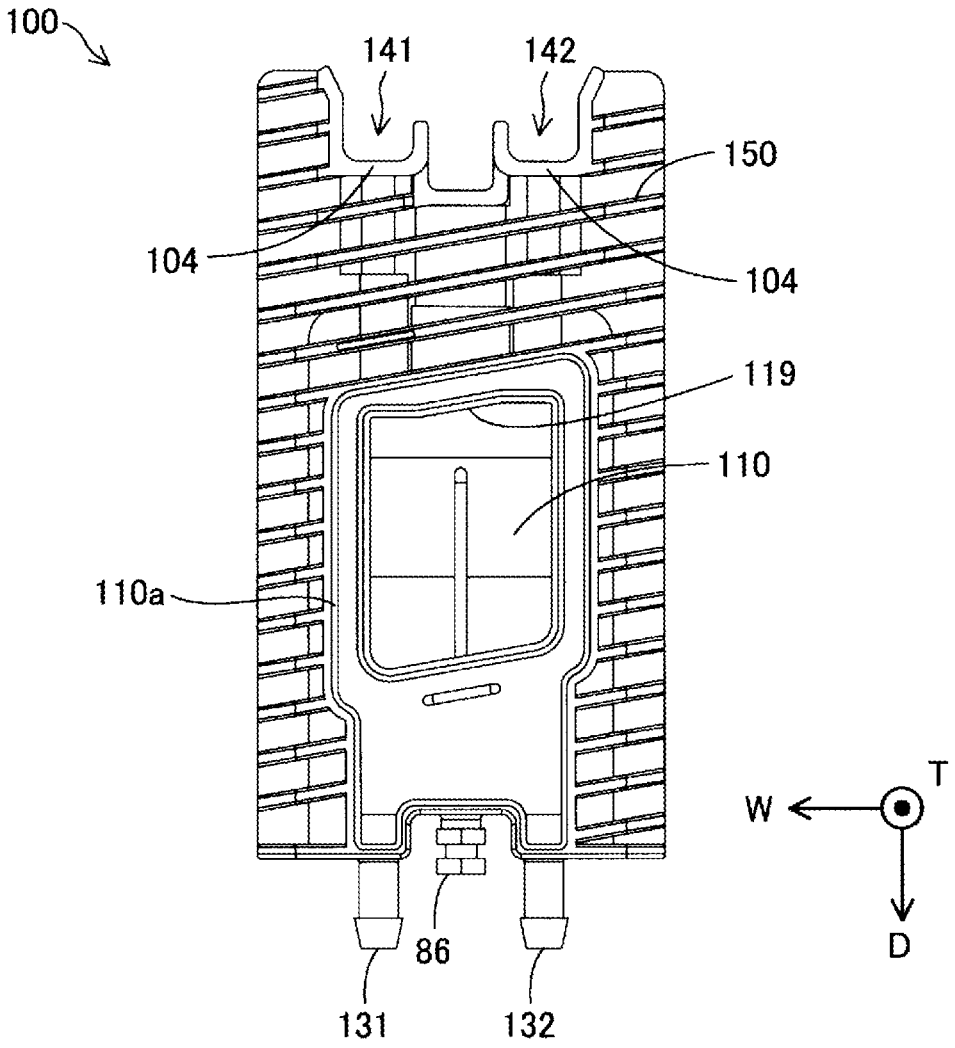
FIG. 12 is a plan view of a frame member forming a filter unit.
Figure 13:
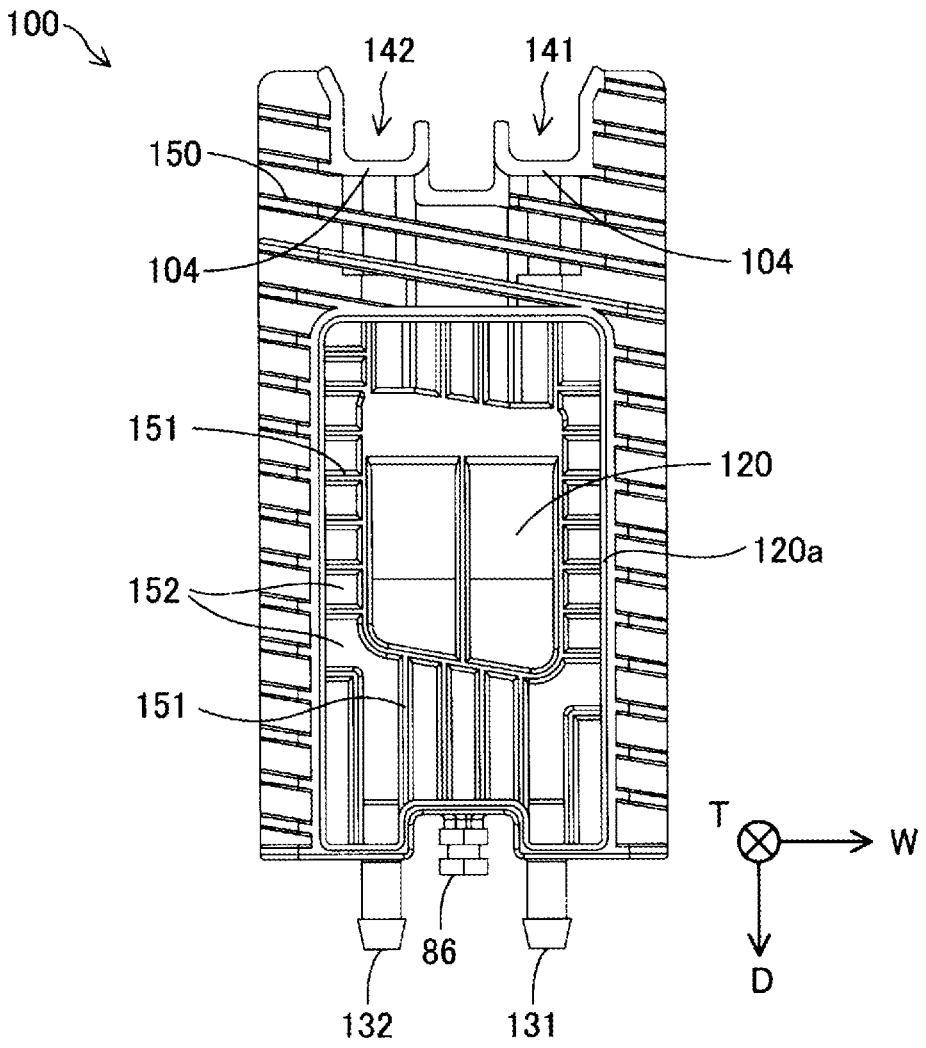
FIG. 13 is a bottom view of the frame member.
Figure 14:
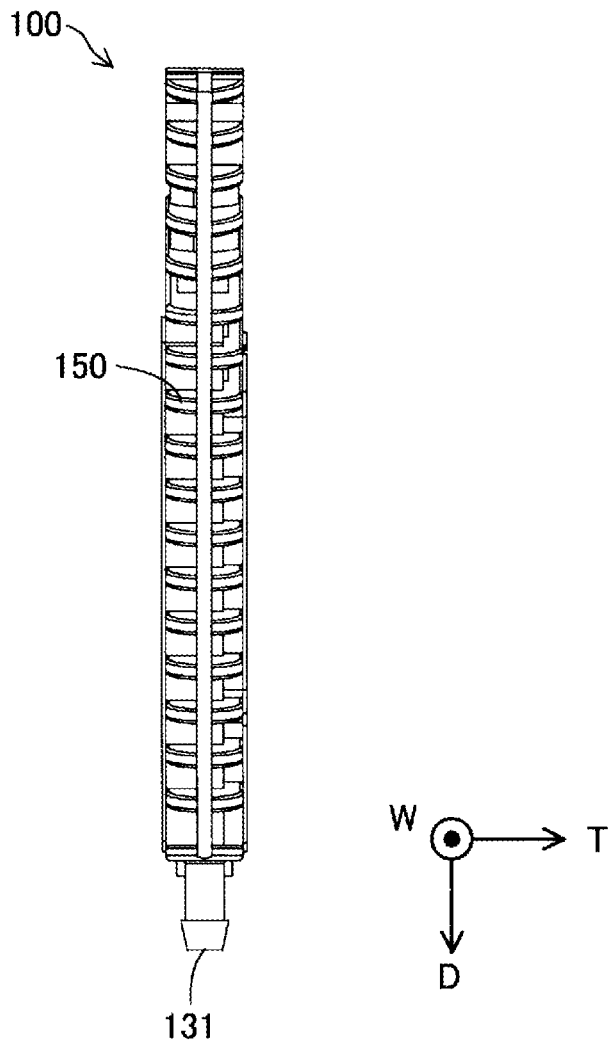
FIG. 14 is a first side view of the frame member.
Figure 15:
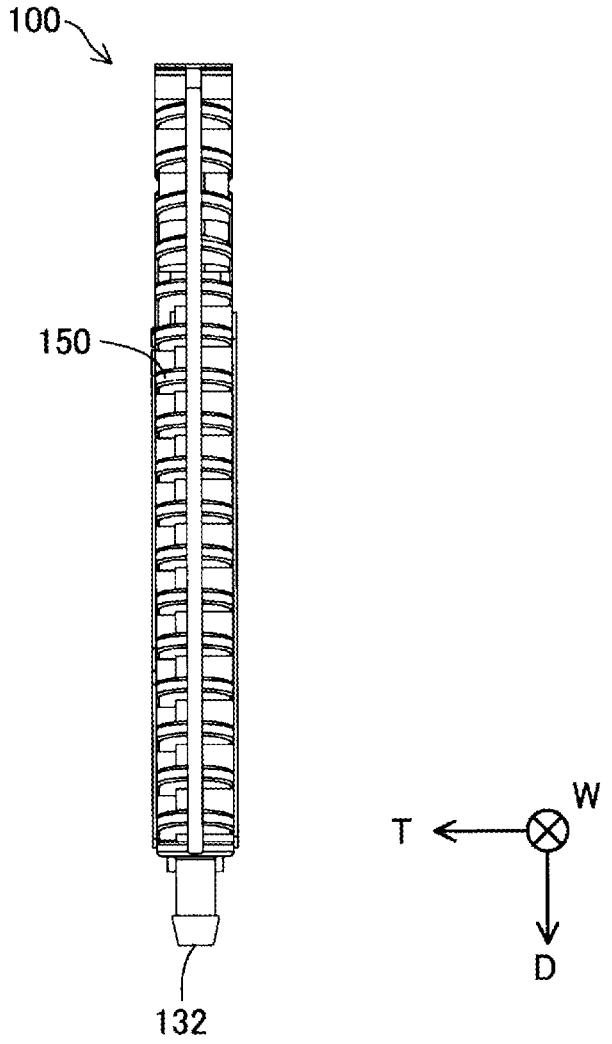
FIG. 15 is a second side view of the frame member.
Figure 16:
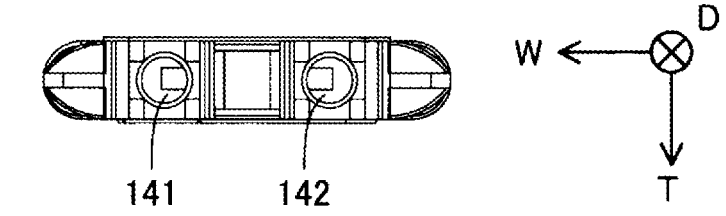
FIG. 16 is a diagram illustrating a −D direction end surface of the frame member.
Figure 17:
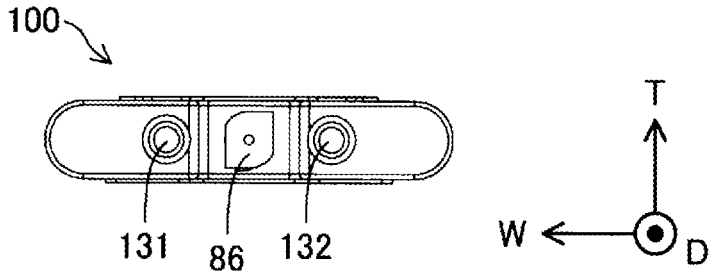
FIG. 17 is a diagram illustrating a +D direction end surface of the frame member.
Figure 18:
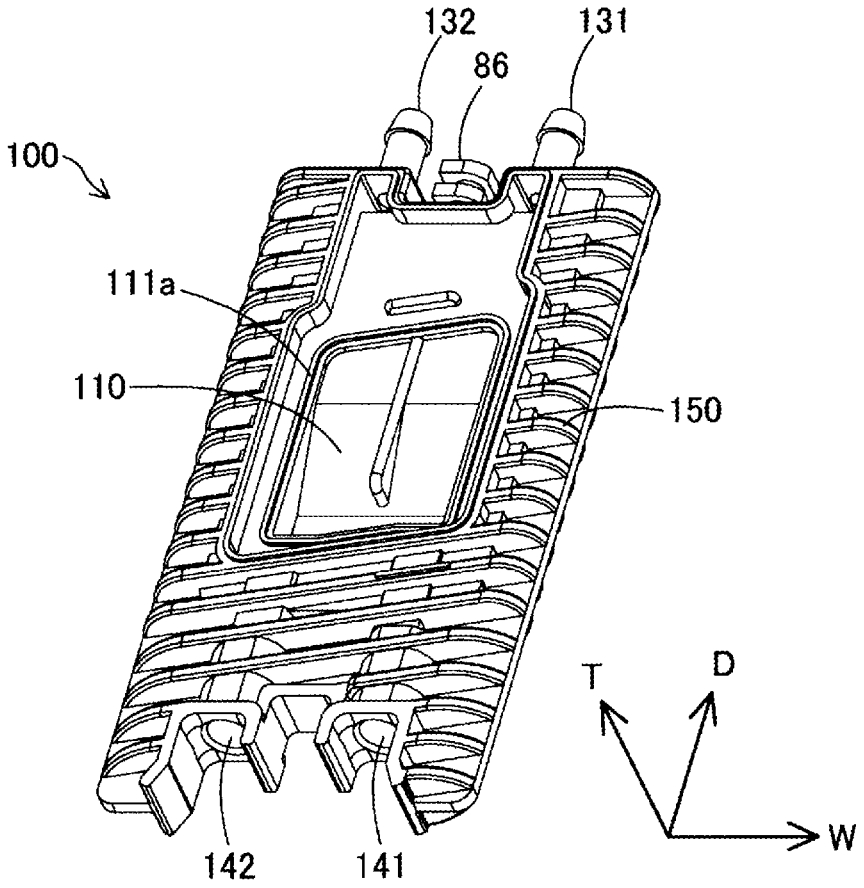
FIG. 18 is a first perspective view of the frame member.
Figure 19:
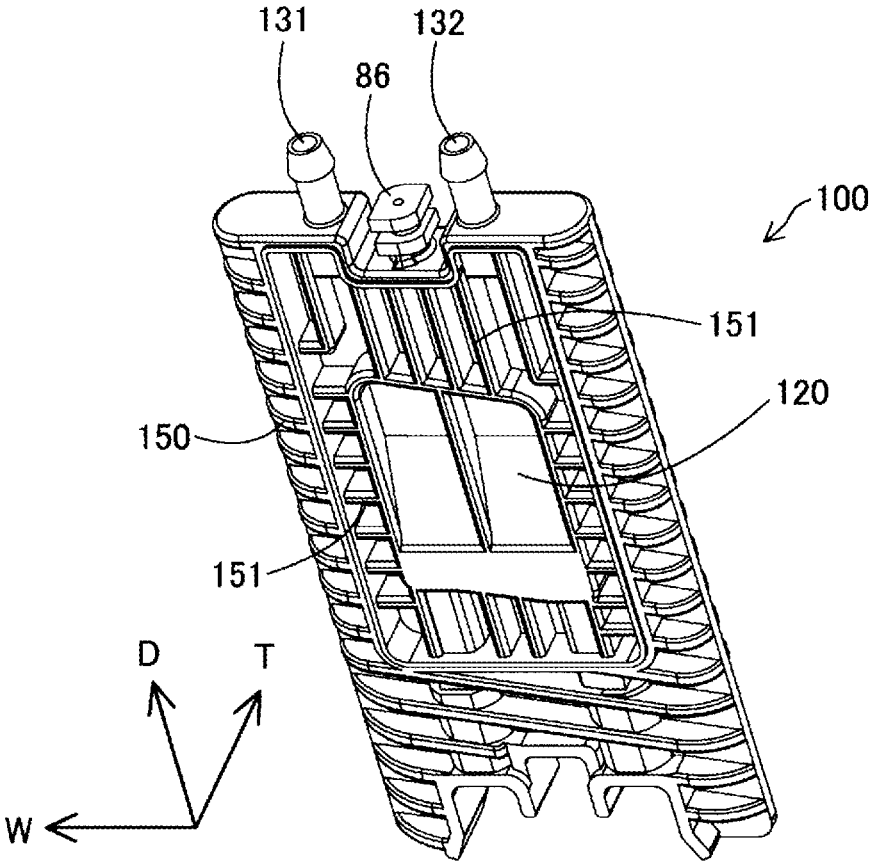
FIG. 19 is a second perspective view of the frame member.
Figure 20:
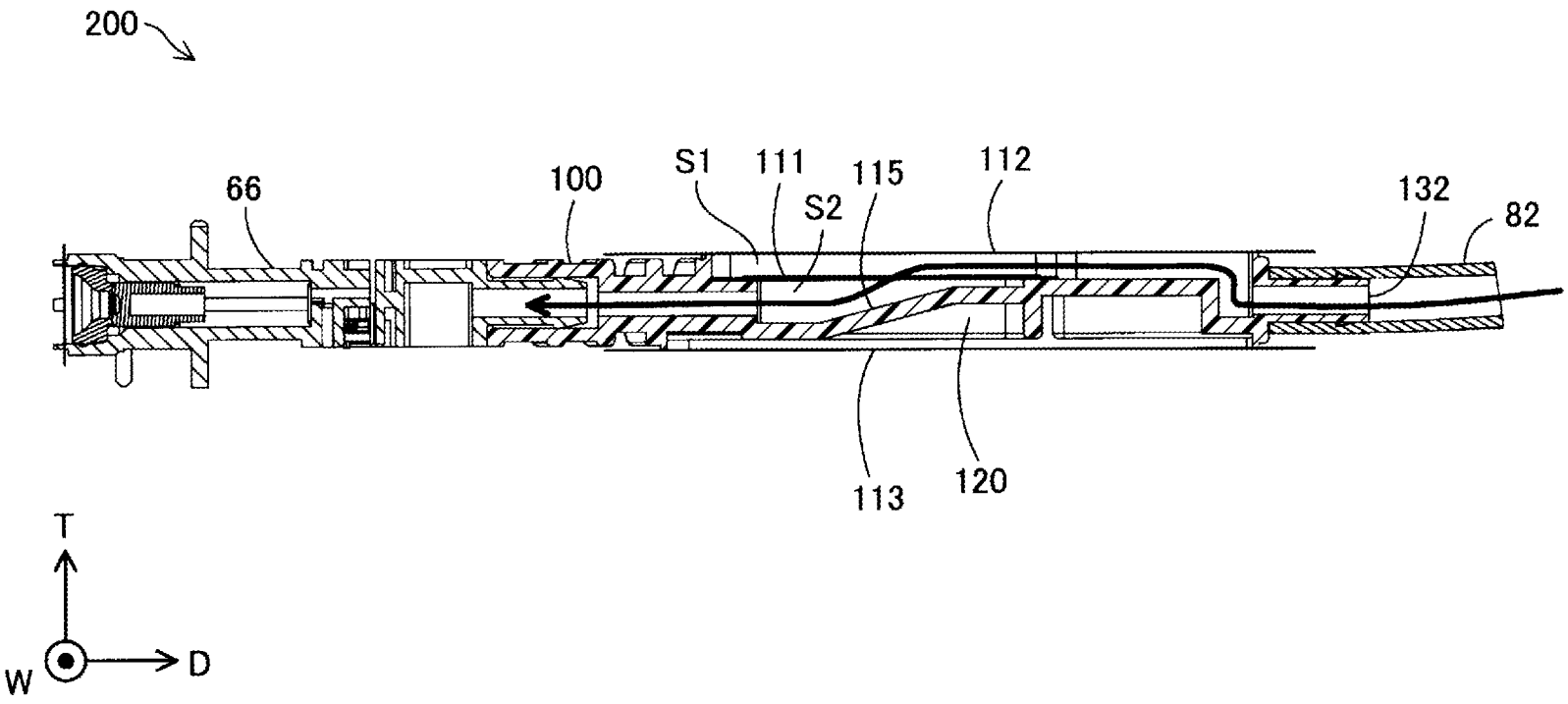
FIG. 20 is a sectional view taken along the line XX-XX in FIG. 7.

FIG. 12 is a plan view of a frame member 101 forming the filter unit 100. FIG. 13 is a bottom view of the frame member 101. FIG. 14 is a first side view of the frame member 101. FIG. 15 is a second side view of the frame member 101. FIG. 16 is a diagram illustrating a −D direction end surface of the frame member 101. FIG. 17 is a diagram illustrating a +D direction end surface of the frame member 101. FIG. 18 is a first perspective view of the frame member 101. FIG. 19 is a second perspective view of the frame member 101. FIG. 20 is a sectional view taken along the line XX-XX in FIG. 7.

As illustrated in FIG. 9, the filter unit 100 includes the frame member 101 formed of a resin material such as polyethylene or polypropylene. As illustrated in FIGS. 12 to 17, the frame member 101 has a substantially rectangular parallelepiped shape. The frame member 101 has a depression for forming a filter chamber 110 described later on an upper surface, and a depression for forming a decompression chamber 120 on a lower surface. In the present embodiment, a plurality of external ribs 150 are formed on the outer peripheral surface of the frame member 101. These external ribs 150 are inclined with respect to the W direction.

As illustrated in FIGS. 7 and 8, in the present embodiment, weld portions 104 are provided on the upper and lower surfaces of a −D direction end of the filter unit 100. The weld portions 104 are welded to the opening 60*d* of the bag 60 together with the weld portion 66*a* of the liquid lead-out member 66 when the liquid housing body 20 is manufactured.

As illustrated in FIG. 9, the filter unit 100 is formed by welding a filter 111, a first film 112, and a second film 113 to the frame member 101. The first film 112 is also referred to as the "filter chamber film", and the second film 113 is also referred to as the "decompression chamber film".

As illustrated in FIGS. 7, 8, and 20, the filter unit 100 includes the filter chamber 110 on the +T direction side and the decompression chamber 120 on the −T direction side. As illustrated in FIG. 20, the filter chamber 110 and the decompression chamber 120 are disposed nextnext to each other in the T direction with an intermediate wall 115 interposed therebetween. In the mounted state, the intermediate wall 115 is inclined downward from the +D direction side of the filter unit 100 toward the −D direction side. Therefore, the liquid easily flows from the +D direction side to the −D direction side in the filter chamber 110.

As illustrated in FIG. 20, the filter chamber 110 is partitioned into an upper space S1 and a lower space S2 by the filter 111. In the present embodiment, the filter 111 is formed of an SUS metal mesh. In addition, the filter 111 may be formed of a metal nonwoven fabric. As illustrated in FIG. 7, the filter 111 is welded to an opening 111*a* located between the upper space S1 and the lower space S2 in the T direction. The filter 111 removes foreign matter mixed in the bag 60 or foreign matter generated in the bag 60. The upper space S1 is sealed by welding the first film 112 to an opening 110*a* on the +T direction side of the filter chamber 110.

As illustrated in FIGS. 9 and 12, two second projecting portions 131 and 132, which are cylindrical, are arranged side by side in the W direction at the +D direction end of the filter unit 100. The internal spaces of the second projecting portions 131 and 132 communicate with the upper space S1 of the filter chamber 110 via two flow paths formed in the filter unit 100. Near the −D direction end of the filter unit 100, the two recessed portions 141 and 142 into which the first projecting portions 661 and 662 of the liquid lead-out member 66 are to be press-fitted are formed side by side in the W direction. The two recessed portions 141 and 142 communicate with two flow paths formed in the filter unit 100, and these flow paths communicate with the lower space S2 of the filter chamber 110 through two openings 146 formed in a wall 119 so as to sandwich the central axis CX. The wall 119 is a wall that partitions a portion of the filter chamber 110 and is located on the liquid lead-out member 66 side. In the present embodiment, the wall 119 is inclined with respect to the W direction. The wall 119 is also referred to as the "inclined wall 119". In the present embodiment, the inclination angle of the inclined wall 119 and the inclination angle of the external ribs 150 are substantially equal.

In the present embodiment, as illustrated in FIGS. 7 and 8, a gap 667 is formed in a portion of a boundary between the liquid lead-out member 66 and the filter unit 100 in a state where the first projecting portions 661 and 662 are press-fitted into the recessed portions 141 and 142.

As illustrated in FIG. 9, liquid lead-out tubes 80 are coupled to the second projecting portions 131 and 132. The liquid lead-out tubes 80 include a first flow path portion 81 and a second flow path portion 82. As illustrated in FIG. 10, the first flow path portion 81 is coupled to the first lead-in port 92 provided in the spacer member 90. As illustrated in FIG. 11, the second flow path portion 82 is coupled to the second lead-in port 93 provided in the spacer member 90. The liquid that has flowed from the first lead-in port 92 and the second lead-in port 93 of the spacer member 90 passes through the first flow path portion 81 and the second flow path portion 82 and then flows from the second projecting portions 131 and 132 of the filter unit 100 to the filter unit 100. Then, the liquid flows through the flow path in the filter unit 100 and flows into the upper space S1 of the filter chamber 110. The liquid flowing into the upper space S1 is filtered by the filter 111, flows into the lower space S2, passes through the flow path in the filter unit 100, flows to the first projecting portions 661 and 662 of the liquid lead-out member 66 coupled to the recessed portions 141 and 142, and is led out from the liquid lead-out portion 52.

As illustrated in FIGS. 8 and 9, the decompression chamber 120 is sealed by welding the second film 113 to an opening 120*a* on the −T direction side of the decompression chamber 120. In the present embodiment, the second film 113 is welded to the opening 120*a* of the decompression chamber 120 in a decompression atmosphere. Therefore, the air sealed in the decompression chamber 120 is in a state where the pressure is lower than the atmospheric pressure. In the present embodiment, the decompression chamber 120 does not communicate with other portions such as the liquid housing portion 60*c* and the filter chamber 110. That is, the decompression chamber 120 is an independent chamber. As is well known, the resin material such as polyethylene or polypropylene forming the filter unit 100 has a certain level of gas permeability. Therefore, when air bubbles are present in the filter chamber 110, the air bubbles pass through the intermediate wall 115 and enter and are trapped in the decompression chamber 120 having a low pressure.

As illustrated in FIGS. 13 and 19, a plurality of internal ribs 151 are formed around the decompression chamber 120. The second film 113 that defines the decompression chamber 120 may also be welded to these internal ribs 151. When the second film 113 is also welded to the internal ribs 151, chambers 152 defined by the internal ribs 151 each function as a small decompression chamber. If a slit or the like is provided in a portion of the internal ribs 151, which partition the chambers 152, and communicates with the decompression chamber 120, the pressure in the decompression chamber 120 and each of the chambers 152 can be made uniform.

As illustrated in FIGS. 7 and 8, the D direction dimension of the first film 112 that seals the filter chamber 110 and the second film 113 that seals the decompression chamber 120 is larger than the D direction dimension of these chambers and extends in the +D direction. These extended portions of the first film 112 and the second film 113 are also welded to the −D direction ends of the coupling member 85 when the first film 112 and the second film 113 are to be welded and fixed to the filter unit 100.

Figure 21:
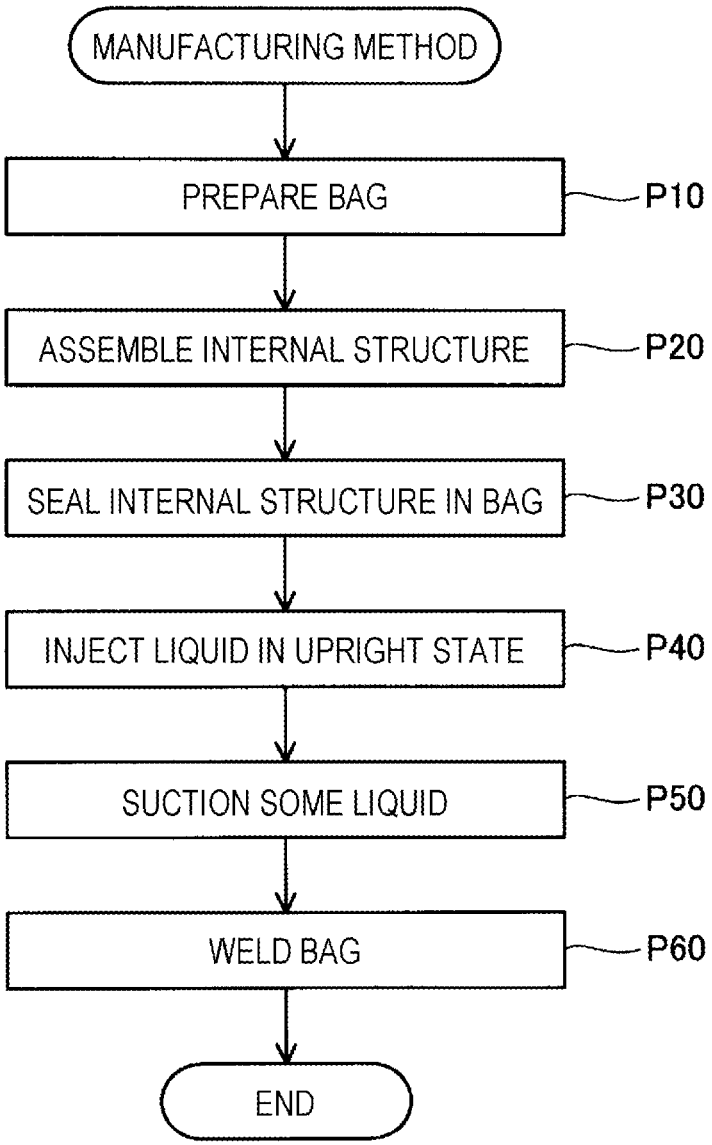
FIG. 21 is a process diagram illustrating a manufacturing method for the liquid housing body.

FIG. 21 is a process diagram illustrating a method for manufacturing the liquid housing body 20. When manufacturing the liquid housing body 20, first, the bag 60 is prepared in a process P10.

In a process P20, the spacer member 90 and the liquid lead-out member 66 are attached to the filter unit 100, and the internal structure 200 is assembled. More specifically, first, the spacer member 90 is attached to the frame member 101 using the coupling member 85. Then, the filter 111 is welded to the frame member 101. Furthermore, the first film 112 is welded to the frame member 101 and the coupling member 85, and the second film 113 is welded to the frame member 101 and the coupling member 85 in a reduced pressure atmosphere. Furthermore, the liquid lead-out tubes 80 are attached to the filter unit 100 and the spacer member 90, and the liquid lead-out member 66 is press-fitted into the filter unit 100 and fixed.

In a process P30, the internal structure 200 is sealed in the bag 60. In a process P30, after the internal structure 200 is sealed in the bag 60, the opening 60*d* of the bag 60 is temporarily welded to the weld portion 66*a* of the liquid lead-out member 66 and the weld portions 104 of the frame member 101 to such an extent that the liquid inlets 665 are not blocked.

In a process P40, the liquid is injected into the bag 60 through the liquid lead-out portion 52 in an upright state in which the liquid lead-out portion 52 faces upward and the spacer member 90 faces downward. At this time, the liquid injected from the liquid lead-out portion 52 is not only injected into the bag 60 through the first projecting portions 661 and 662 and the filter chamber 110, but is also injected into the bag 60 through the liquid inlets 665 provided in the liquid lead-out member 66. When the liquid is injected into the bag 60, the air in the bag 60 moves upward through the external ribs 150 provided on the outer surface of the filter unit 100. In addition, the air in the filter chamber 110 moves upward along the inclined wall 119 inclined with respect to the horizontal direction in an upright state.

In a process P50, some of the liquid injected into the bag 60 is sucked through the liquid lead-out portion 52 in the above-described upright state. By this suction, air bubbles in each portion in the bag 60 are discharged out of the bag 60. For example, air bubbles accumulated in the upper portion of the bag 60 move through the gap 667 between the liquid lead-out member 66 and the filter unit 100 and move along the front and rear of the internal structure 200, and are discharged outside together with the liquid through the liquid inlets 665 and the liquid lead-out portion 52. In addition, air bubbles in the filter unit 100 pass through the flow path formed in the filter unit 100 and the flow path in the first projecting portion 661 and are discharged to the outside through the liquid lead-out portion 52.

In a process P60, the opening 60*d* of the bag 60 is completely welded to the weld portion 66*a* of the liquid lead-out member 66 and the weld portion 104 of the frame member 101. Through the above processes, the liquid inlets 665 are closed and the liquid housing body 20 is completed.

According to the liquid housing body 20 of the present embodiment described above, the filter unit 100 is provided in the bag 60, and the liquid is led out from the liquid lead-out portion 52 to the liquid ejecting apparatus 11 through the filter 111 provided in the filter unit 100. Therefore, foreign matter in the liquid housing body 20 can be suppressed from flowing into the liquid ejecting apparatus 11.

In addition, according to the present embodiment, the filter unit 100 includes the filter chamber 110 and the decompression chamber 120, and the filter chamber 110 and the decompression chamber 120 are arranged next to each other with the intermediate wall 115 interposed therebetween. Therefore, even if air bubbles remain in the filter chamber 110 after the liquid housing body 20 is manufactured, the air bubbles can be caught by the decompression chamber 120 by passing through the intermediate wall 115.

In addition, in the present embodiment, the liquid that has flowed into the filter unit 100 through the liquid lead-out tubes 80 flows from the upper space S1 of the filter chamber 110 to the lower space S2 through the filter 111. Therefore, even if air bubbles flow into the filter chamber 110 from the bag 60, the air bubbles tend to stay in the upper space S1. Therefore, it is possible to suppress the air bubbles from being discharged to the liquid ejecting apparatus 11.

In addition, according to the present embodiment, the decompression chamber 120 is configured by welding a film to the opening 120*a* of the decompression chamber 120 in a decompression atmosphere. Therefore, the decompression chamber 120 can be easily formed with a simple structure. As a result, it is not necessary to arrange a complicated mechanism such as a pump in the liquid housing body 20, and the manufacturing cost of the liquid housing body 20 can be reduced.

In addition, in the present embodiment, the first film 112 and the second film 113 that are welded to the filter chamber 110 and the decompression chamber 120 are welded not only to the filter chamber 110 and the decompression chamber 120 but also to a portion of the coupling member 85. Therefore, the spacer member 90 can be stably disposed in the bag 60, and it is possible to suppress detachment of the spacer member 90 from the filter unit 100 due to an impact such as when dropped.

In addition, in the present embodiment, the first projecting portions 661 and 662 formed on the liquid lead-out member 66 are press-fitted into the recessed portions 141 and 142 formed on the filter unit 100, so that the filter unit 100 is fixed to the liquid lead-out member 66, and the weld portion 104 of the liquid lead-out member 66 and the weld portion 66*a* of the filter unit 100 are both welded to the bag 60. Therefore, the leakage of the liquid from the fitting portion of the liquid lead-out member 66 and the filter unit 100 can be suppressed, and, furthermore, since the liquid lead-out member 66 and the filter unit 100 are welded together to the bag 60, it is possible to suppress the liquid lead-out member 66 and the filter unit 100 from being detached due to an impact or the like.

In addition, in the present embodiment, the filter chamber 110 is provided with the inclined wall 119 inclined with respect to the horizontal in an upright state in which the liquid lead-out portion 52 faces upward and the spacer member 90 faces downward. Therefore, when the liquid housing body 20 is manufactured, the air bubbles easily move upward in the filter chamber 110, and the air bubbles are easily discharged to the outside. In particular, in the present embodiment, since two openings 146 communicating with the liquid lead-out portion 52 are formed in the inclined wall 119 at a position sandwiching the center axis CX, in the upright state, one of the openings 146 is positioned above the other one of the openings 146 in the vertical direction. Accordingly, the air bubbles in the filter chamber 110 are easily discharged to the outside through the upper one of the openings 146.

In addition, in the present embodiment, the outer surface of the filter unit 100 is provided with the external ribs 150 that are inclined with respect to the horizontal in an upright state in which the liquid lead-out portion 52 faces upward and the spacer member 90 faces downward. Therefore, the air bubbles in the bag 60 easily move upward, and the air bubbles can be easily discharged from the liquid inlets 665 when the liquid housing body 20 is manufactured.

In addition, in the present embodiment, since the gap 667 is formed at a portion of the boundary between the liquid lead-out member 66 and the filter unit 100, the air bubbles in the bag 60 can easily move through the gap. Therefore, it is easy to discharge the air bubbles to the outside when the liquid housing body 20 is manufactured.

In addition, in the present embodiment, the spacer member 90 has the first lead-in port 92 and the second lead-in port 93 for introducing the liquid in the bag 60, and the first lead-in port 92 and the second lead-in port 93 are connected to the filter chamber 110 of the filter unit 100 via the liquid lead-out tubes 80. Therefore, the liquid around the spacer member 90 can be efficiently led out from the liquid lead-out portion 52 to the liquid ejecting apparatus 11. In particular, in the present embodiment, the first lead-in port 92 and the second lead-in port 93 provided in the spacer member 90 are arranged in the vertical direction in the mounted state and liquid that flows in through the first lead-in port 92 and the second lead-in port 93 is mixed in the filter chamber 110 or the liquid lead-out member 66 after being converted into a state of flowing in the horizontal direction by the first flow path portion 81 and the second flow path portion 82 forming the liquid discharge tubes 80. Therefore, the concentration of the liquid supplied to the liquid ejecting apparatus 11 can be stabilized.

In addition, in the present embodiment, since the spacer member 90 is disposed in the bag 60, a highly concentrated liquid containing a large amount of sedimentation components can be left in and around the spacer member 90. Therefore, the concentration of the liquid supplied to the liquid ejecting apparatus 11 can be stabilized. In particular, in the present embodiment, the thickness of the spacer member 90 in the thickness direction is larger than that of the filter unit 100. Therefore, the shrinkage of the bag 60 in the vicinity of the spacer member 90 is regulated more than other portions, and a liquid having a high concentration can be efficiently left in and around the spacer member 90.

B. Other Embodiment

Figure 22:
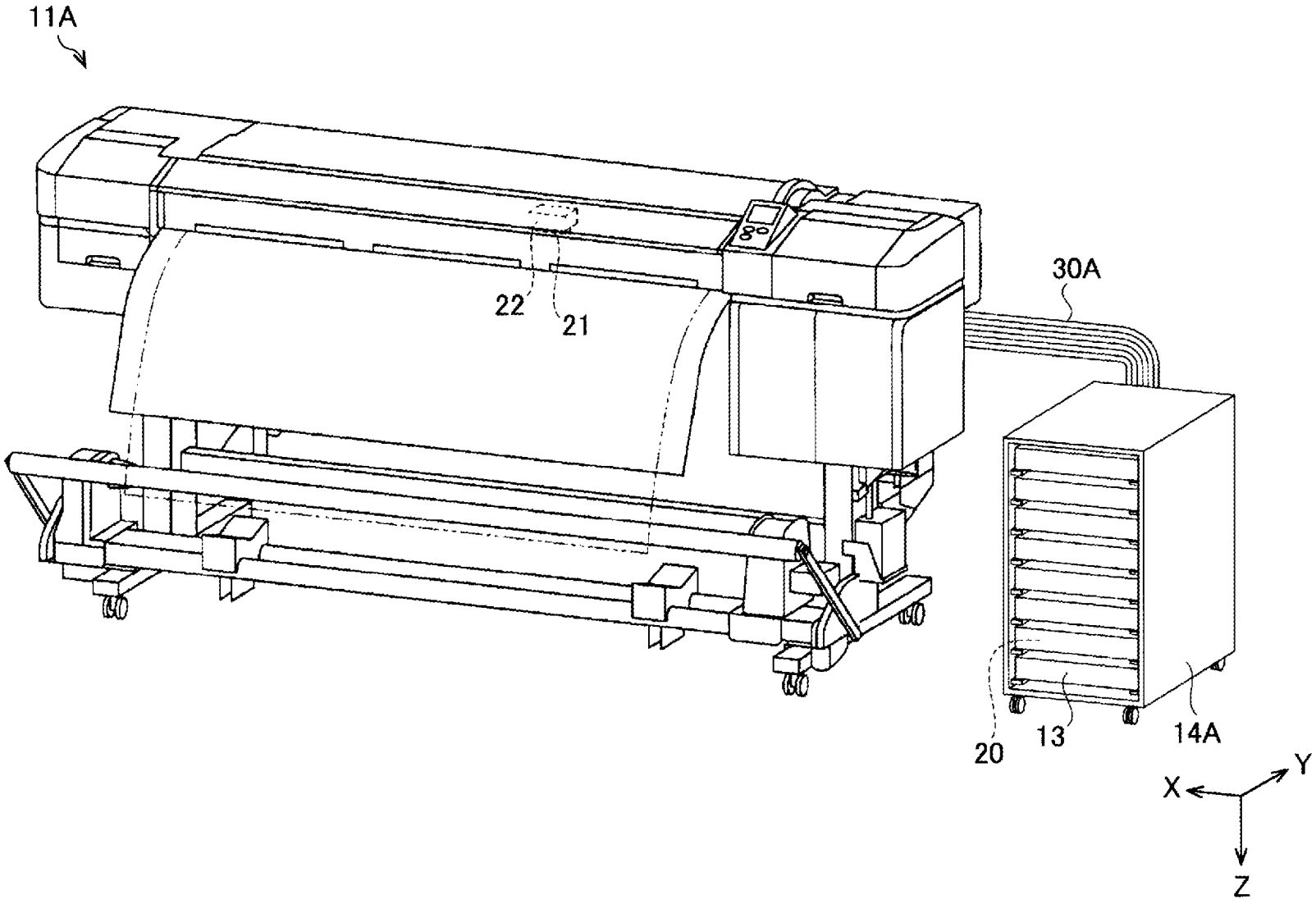
FIG. 22 is a diagram illustrating another embodiment of the liquid ejecting apparatus.

B-1. FIG. 22 is a diagram illustrating another embodiment of the liquid ejecting apparatus 11. In the above embodiment, as illustrated in FIG. 1, the liquid housing body 20 and the container 13 are housed in the mounting portion 14 disposed at the lower portion of the liquid ejecting apparatus 11. However, the embodiment of the liquid ejecting apparatus 11 is not limited to such an embodiment. For example, as illustrated in FIG. 22, the main body of a liquid ejecting apparatus 11A and a mounting portion 14A in which the container 13 and the liquid housing body 20 are housed may be separated. In this case, the mounting portion 14A and the main body of the liquid ejecting apparatus 11A are coupled to each other by supply flow paths 30A formed of tubes or the like, and the liquid flows through the supply flow paths 30A.

B-2. In the above embodiment, the first projecting portions 661 and 662 of the liquid lead-out member 66 are press-fitted into the recessed portions 141 and 142 of the filter unit 100 to fix the filter unit 100 to the liquid lead-out member 66. On the other hand, the filter unit 100 and the liquid lead-out member 66 need not be fixed. For example, the filter unit 100 and the liquid lead-out member 66 may be coupled by a tube.

B-3. In the above embodiment, the liquid housing body 20 includes the decompression chamber 120. On the other hand, the liquid housing body 20 need not include the decompression chamber 120. Even in this case, since the liquid housing body 20 includes the filter chamber 110, it is possible to suppress foreign matter in the liquid housing body 20 from flowing into the liquid ejecting apparatus 11.

B-4. In the above embodiment, the decompression chamber 120 is formed by welding the second film 113 to the opening 120*a* of the decompression chamber 120 in a decompression atmosphere. However, the decompression chamber 120 may be formed by using other methods without using such a method. For example, a check valve may be provided on the second film 113, and after the second film 113 is welded to the opening 120*a* of the decompression chamber 120, the inside of the decompression chamber 120 may be decompressed via the check valve.

B-5. In the above embodiment, both the first film 112 and the second film 113 are welded to the coupling member 85. On the other hand, one of the first film 112 and the second film 113 may be welded to the coupling member 85. In addition, the first film 112 and the second film 113 need not be welded to the coupling member 85.

B-6. In the above embodiment, the liquid lead-out member 66 and the filter unit 100 are both welded to the opening 60*d* of the bag 60. On the other hand, the filter unit 100 need not be welded to the bag 60.

B-7. In the above embodiment, the wall 119 defining the filter chamber 110 in the upright state is inclined with respect to the horizontal direction, but the wall 119 need not be inclined.

B-8. In the above embodiment, in the upright state, the external ribs 150 provided in the filter unit 100 are inclined with respect to the horizontal direction. On the other hand, the external ribs 150 need not be inclined. In addition, the filter unit 100 need not include the external ribs 150.

B-9. In the above embodiment, the gap 667 is formed at a portion of the boundary between the liquid lead-out member 66 and the filter unit 100. On the other hand, the gap 667 need not be provided at the boundary between the liquid lead-out member 66 and the filter unit 100.

B-10. In the above embodiment, the spacer member 90 includes the lead-in ports 92 and 93 for introducing the liquid in the bag 60, and the lead-in ports 92 and 93 and the filter unit 100 are coupled to each other by the liquid lead-out tubes 80. However, the spacer member 90 need not include the lead-in ports 92 and 93. In this case, the liquid may flow directly into the filter chamber 110 from the second projecting portions 131 and 132 of the filter unit 100. In addition, the liquid may be allowed to flow from ends of the liquid lead-out tubes 80 without coupling the liquid lead-out tubes 80 to the spacer member 90.

B-11. The present disclosure is not limited to an ink jet printer and a liquid housing body for supplying ink to the ink jet printer, and the present disclosure can also be applied to liquid ejecting apparatuses that eject a liquid other than ink and liquid housing bodies used in those liquid ejecting apparatuses. For example, the present disclosure can be applied to the following various liquid ejecting apparatuses and their liquid housing bodies.

1. An image recording apparatus such as a facsimile apparatus.

2. A color material ejecting apparatus used for manufacturing a color filter for an image display device such as a liquid crystal display.

3. An electrode material ejecting apparatus used for forming electrodes of an organic electroluminescence (EL) display, a surface emitting display (field emission display (FED), and the like.

4. A liquid ejecting apparatus that ejects a liquid containing biological organic matter used for producing a biochip.

5. A sample ejecting apparatus as a precision pipette.

6. A lubricant ejecting apparatus.

7. A resin liquid ejecting apparatus.

8. A liquid ejecting apparatus that ejects lubricating oil pinpoint to a precision machine such as a watch or a camera.

9. A liquid ejecting apparatus that ejects a transparent resin liquid such as an ultraviolet curable resin liquid onto a substrate in order to form a micro hemispherical lens (optical lens) used for an optical communication element or the like.

10. A liquid ejecting apparatus that ejects an acidic or alkaline etching solution to etch a substrate or the like.

11. A liquid ejecting apparatus including a liquid consuming head that ejects another arbitrary minute amount of liquid droplets.

Further, the term "droplet" refers to a state of liquid discharged from a liquid ejecting apparatus, and includes granular, teardrop-like, and threadlike tails. In addition, the term "liquid" referred to here may be any material that can be consumed by the liquid ejecting apparatus. For example, the term "liquid" may refer to any material as long as the material is in a liquid phase, for example, liquid materials such as materials having a high or low viscosity state, sols, gel water, other inorganic solvents, organic solvents, liquid resin and liquid metal (metal melt) are also covered by the term "liquid". In addition, not only liquid as one state of matter, but also particles of a functional material composed of a solid material such as pigment and metal particles dissolved, dispersed or mixed in a solvent are covered by the term "liquid". Representative examples of liquids include ink and liquid crystal. Herein, examples of ink include various liquid compositions such as general water-based ink and oil-based ink, gel ink, hot melt ink and the like.

C. Other Aspects

The present disclosure is not limited to the above-described embodiment, and can be realized in various configurations without departing from the gist thereof. For example, the technical features of the embodiments corresponding to the technical features in each of the aspects described below may be used to solve some or all of the above-mentioned problems, and may be replaced or combined as necessary in order to accomplish some or all of the effects of the disclosure. In addition, unless technical features are described as essential in this specification, they can be deleted as appropriate.

1. According to a first aspect of the present disclosure, a liquid housing body is provided. The liquid housing body includes a bag that is flexible and that houses a liquid therein, a liquid lead-out member that is attached to an end of the bag and that includes a liquid lead-out portion for leading the liquid in the bag to a liquid ejecting apparatus, a spacer member disposed in the bag, and a filter unit that is disposed between the liquid lead-out member and the spacer member in the bag and that supplies the liquid to the liquid lead-out member through a filter, in which, in a use state of the liquid housing body, the liquid lead-out member, the filter unit, and the spacer member are aligned in a horizontal direction.

In this case, because the filter unit is provided in the bag, and the liquid is led out from the liquid lead-out portion to the liquid ejecting device through the filter provided in the filter unit, the flow of foreign matter into the liquid ejecting apparatus can be suppressed.

2. In the liquid housing body of the above aspect, the filter unit may include a filter chamber communicating with the liquid lead-out portion and having the filter, and a decompression chamber disposed next to the filter chamber and decompressed inside. In this case, even if air bubbles are present in the filter chamber, the air bubbles can be captured by the decompression chamber.

3. In the liquid housing body of the above aspect, the decompression chamber may have a film welded to an opening of the decompression chamber in a decompression atmosphere. In this case, a decompression chamber can be formed easily.

4. The liquid housing body of the above aspect may further include a coupling member that couples the spacer member to the filter unit, and the decompression chamber film may be welded to at least portion of the coupling member. In this case, the spacer member can be stably disposed in the bag.

5. The liquid housing body of the above aspect may further include a coupling member that couples the spacer member to the filter unit, and the filter chamber may have a filter chamber film welded to an opening of the filter chamber, and the filter chamber film may be welded to at least portion of the coupling member. In this case, the spacer member can be stably disposed in the bag.

6. In the liquid housing body of the above aspect, in an upright state in which the liquid lead-out portion faces upward and the spacer member faces downward, a wall on a liquid lead-out member side that defines the filter chamber may be inclined with respect to the horizontal direction. In this case, air bubbles in the filter chamber easily move upward in an upright state. For this reason, it is easy to discharge air bubbles during the manufacture of the liquid housing body.

7. In the liquid housing body of the above aspect, the filter unit may be attached to the liquid lead-out member by press-fitting a projecting portion formed in the liquid lead-out member into a recessed portion formed in the filter unit, and at least portion of the liquid lead-out member and at least portion of the filter unit may be welded to the bag. In this case, the filter unit can be stably disposed in the bag.

8. In the liquid housing body of the above aspect, a rib inclined with respect to the horizontal direction in an upright state in which the liquid lead-out portion faces upward and the spacer member faces downward may be provided on an outer surface of the filter unit. In this case, the air bubbles in the bag will move easily upwards. For this reason, it is easy to discharge the air bubbles during the manufacture of the liquid housing body.

9. In the liquid housing body of the above aspect, a gap may be provided at a boundary between the liquid lead-out member and the filter unit. In this case, the air bubbles in the bag will move easily through the gap. For this reason, it is easy to discharge the air bubbles during the manufacture of the liquid housing body.

10. The liquid housing body of the above aspect may further include a liquid lead-out tube that enables the filter unit and a lead-in port for introducing the liquid in the bag to communicate with each other, and the spacer member may have the lead-in port. In this case, the liquid around the spacer member can be efficiently led out from the liquid lead-out portion to the liquid ejecting apparatus.

11. According to a second aspect of the present disclosure, a method for manufacturing the liquid housing body according to the above aspect is provided. The manufacturing method includes preparing the bag, attaching the spacer member and the liquid lead-out member to the filter unit, enclosing the filter unit, the spacer member, and the liquid lead-out member in the bag, injecting the liquid into the bag through the liquid lead-out portion in an upright state in which the liquid lead-out portion faces upward and the spacer member faces downward, and sucking some of the liquid injected into the bag from the liquid lead-out portion in the upright state. According to such an aspect, it is possible to suppress air bubbles from remaining in the liquid housing body.

The present disclosure is not limited to the liquid housing body and the manufacturing method thereof described above, but can be realized as various aspects such as a liquid ejecting apparatus and a liquid ejecting system.

What is claimed is:

1. A liquid housing body comprising:

a bag that is flexible and that houses a liquid therein;

a liquid lead-out member that is attached to an end of the bag and that includes a liquid lead-out portion for leading the liquid in the bag to a liquid ejecting apparatus;

a spacer member disposed in the bag; and a filter unit that is disposed between the liquid lead-out member and the spacer member in the bag and that supplies the liquid to the liquid lead-out member through a filter, wherein in a use state of the liquid housing body, the liquid lead-out member, the filter unit, and the spacer member are aligned in a horizontal direction, the filter unit is attached to the liquid lead-out member by press-fitting a projecting portion formed in the liquid lead-out member into a recessed portion formed in the filter unit, and at least a portion of the liquid lead-out member and at least a portion of the filter unit are welded to the bag.

2. The liquid housing body according to claim 1, wherein the filter unit includes:

a filter chamber communicating with the liquid lead-out portion and having the filter, and a decompression chamber disposed next to the filter chamber and decompressed atmosphere inside.

3. The liquid housing body according to claim 2, wherein the decompression chamber has a decompression chamber film welded to an opening of the decompression chamber in a decompression atmosphere.

4. The liquid housing body according to claim 3, further comprising a coupling member that couples the spacer member to the filter unit, wherein the decompression chamber film is welded to at least a portion of the coupling member.

5. The liquid housing body according to claim 2, further comprising:

a coupling member that couples the spacer member to the filter unit, wherein the filter chamber has a filter chamber film welded to an opening of the filter chamber, and the filter chamber film is welded to at least a portion of the coupling member.

6. The liquid housing body according to claim 2, wherein in an upright state in which the liquid lead-out portion faces upward and the spacer member faces downward, a wall on a liquid lead-out member side that defines the filter chamber is inclined with respect to the horizontal direction.

7. The liquid housing body according to claim 1, wherein a gap is provided at a boundary between the liquid lead-out member and the filter unit.

8. A method for manufacturing the liquid housing body according to claim 1, comprising:

preparing the bag;

attaching the spacer member and the liquid lead-out member to the filter unit;

disposing the filter unit, the spacer member, and the liquid lead-out member in the bag:

injecting the liquid into the bag through the liquid lead-out portion in an upright state in which the liquid lead-out portion faces upward and the spacer member faces downward; and sucking some of the liquid injected into the bag from the liquid lead-out portion in the upright state.

9. A liquid housing body comprising:

a bag that is flexible and that houses a liquid therein;

a liquid lead-out member that is attached to an end of the bag and that includes a liquid lead-out portion for leading the liquid in the bag to a liquid ejecting apparatus;

a spacer member disposed in the bag; and a filter unit that is disposed between the liquid lead-out member and the spacer member in the bag and that supplies the liquid to the liquid lead-out member through a filter, wherein in a use state of the liquid housing body, the liquid lead-out member, the filter unit, and the spacer member are aligned in a horizontal direction, and a rib inclined with respect to the horizontal direction in an upright state in which the liquid lead-out portion faces upward and the spacer member faces downward is provided on an outer surface of the filter unit.

10. The liquid housing body according to claim 9, wherein the filter unit includes:

a filter chamber communicating with the liquid lead-out portion and having the filter, and a decompression chamber disposed next to the filter chamber and decompressed atmosphere inside.

11. The liquid housing body according to claim 10, wherein the decompression chamber has a decompression chamber film welded to an opening of the decompression chamber in a decompression atmosphere.

12. The liquid housing body according to claim 10, wherein in an upright state in which the liquid lead-out portion faces upward and the spacer member faces downward, a wall on a liquid lead-out member side that defines the filter chamber is inclined with respect to the horizontal direction.

13. The liquid housing body according to claim 9, wherein a gap is provided at a boundary between the liquid lead-out member and the filter unit.

14. A method for manufacturing the liquid housing body according to claim 9, comprising:

preparing the bag;

attaching the spacer member and the liquid lead-out member to the filter unit;

disposing the filter unit, the spacer member, and the liquid lead-out member in the bag:

injecting the liquid into the bag through the liquid lead-out portion in an upright state in which the liquid lead-out portion faces upward and the spacer member faces downward; and sucking some of the liquid injected into the bag from the liquid lead-out portion in the upright state.

15. A liquid housing body comprising:

a bag that is flexible and that houses a liquid therein;

a liquid lead-out member that is attached to an end of the bag and that includes a liquid lead-out portion for leading the liquid in the bag to a liquid ejecting apparatus;

a spacer member disposed in the bag;

a filter unit that is disposed between the liquid lead-out member and the spacer member in the bag and that supplies the liquid to the liquid lead-out member through a filter; and a liquid lead-out tube that enables the filter unit and a lead-in port for introducing the liquid in the bag to communicate with each other, wherein in a use state of the liquid housing body, the liquid lead-out member, the filter unit, and the spacer member are aligned in a horizontal direction, and the spacer member has the lead-in port.

16. The liquid housing body according to claim 15, wherein the filter unit includes:

a filter chamber communicating with the liquid lead-out portion and having the filter, and a decompression chamber disposed next to the filter chamber and decompressed atmosphere inside.

17. The liquid housing body according to claim 16, wherein the decompression chamber has a decompression chamber film welded to an opening of the decompression chamber in a decompression atmosphere.

18. The liquid housing body according to claim 16, wherein in an upright state in which the liquid lead-out portion faces upward and the spacer member faces downward, a wall on a liquid lead-out member side that defines the filter chamber is inclined with respect to the horizontal direction.

19. The liquid housing body according to claim 15, wherein a gap is provided at a boundary between the liquid lead-out member and the filter unit.

20. A method for manufacturing the liquid housing body according to claim 15, comprising:

preparing the bag;

attaching the spacer member and the liquid lead-out member to the filter unit;

disposing the filter unit, the spacer member, and the liquid lead-out member in the bag:

injecting the liquid into the bag through the liquid lead-out portion in an upright state in which the liquid lead-out portion faces upward and the spacer member faces downward; and sucking some of the liquid injected into the bag from the liquid lead-out portion in the upright state.

* * * * *